US012790657B2

(12) United States Patent
Nishida et al.

(10) Patent No.: US 12,790,657 B2
(45) Date of Patent: Nov. 10, 2026

(54) FERRITIC STAINLESS STEEL SHEET AND PRODUCTION METHOD THEREFOR

(71) Applicant: JFE STEEL CORPORATION, Tokyo (JP)

(72) Inventors: Shuji Nishida, Tokyo (JP); Ayako Ta, Tokyo (JP); Hirokazu Tanaka, Tokyo (JP); Yasutada Sunamori, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 401 days.

(21) Appl. No.: 18/681,514

(22) PCT Filed: Jun. 1, 2022

(86) PCT No.: PCT/JP2022/022363

§ 371 (c)(1),
(2) Date: Feb. 6, 2024

(87) PCT Pub. No.: WO2023/032377

PCT Pub. Date: Mar. 9, 2023

(65) Prior Publication Data

US 2025/0059615 A1 Feb. 20, 2025

(30) Foreign Application Priority Data

Sep. 2, 2021 (JP) ..... 2021-143469

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/004* (2013.01); *C21D 8/02* (2013.01); *C21D 8/0236* (2013.01);
(Continued)

(58) Field of Classification Search
None
See application file for complete search history.

(56) References Cited

U.S. PATENT DOCUMENTS

2003/0094217 A1 5/2003 Yazawa et al.
2010/0136330 A1 6/2010 Ueda et al.
(Continued)

FOREIGN PATENT DOCUMENTS

CN 101668628 A 3/2010
CN 106583449 A * 4/2017 ..... C22C 38/001
(Continued)

OTHER PUBLICATIONS

English language machine translation of JP-2020056878-A. Generated Jun. 5, 2026. (Year: 2026).*
(Continued)

*Primary Examiner* — Brian D Walck
(74) *Attorney, Agent, or Firm* — KENJA IP LAW PC

(57) ABSTRACT

Provided is a ferritic stainless steel sheet having both high whiteness and high image clarity. A surface of the ferritic stainless steel sheet is made up of plateau portions and valley portions, an area ratio of the plateau portions is 30% to 70%, Sdr of the plateau portions is 0.100 or less, Sdq of the valley portions is 0.20 or more, Sal is 50 μm or less, and Str is 0.30 or more.

16 Claims, 2 Drawing Sheets

(51) Int. Cl.

| | |
|---|---|
| ***C21D 8/02*** | (2026.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/50*** | (2006.01) |
| ***C22C 38/52*** | (2006.01) |
| ***C22C 38/54*** | (2006.01) |
| ***C22C 38/60*** | (2006.01) |
| ***C25F 1/06*** | (2006.01) |

(52) U.S. Cl.
CPC ..... *C21D 8/0247* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/50* (2013.01); *C22C 38/52* (2013.01); *C22C 38/54* (2013.01); *C22C 38/60* (2013.01); *C25F 1/06* (2013.01); *C21D 2211/005* (2013.01)

(56) References Cited

U.S. PATENT DOCUMENTS

| | | | |
|---|---|---|---|
| 2018/0078981 | A1 | 3/2018 | Kawagoe et al. |
| 2019/0226044 | A1 | 7/2019 | Kawagoe et al. |

FOREIGN PATENT DOCUMENTS

| | | | | |
|---|---|---|---|---|
| CN | 109312432 | A | | 2/2019 |
| JP | H08239733 | A | | 9/1996 |
| JP | 2000233205 | A | | 8/2000 |
| JP | 2001335997 | A | * | 12/2001 |
| JP | 2003201547 | A | | 7/2003 |
| JP | 2006142343 | A | | 6/2006 |
| JP | 2012201950 | A | | 10/2012 |
| JP | 2016196019 | A | | 11/2016 |
| JP | 2017179519 | A | | 10/2017 |
| JP | 2020056878 | A | * | 4/2020 |
| JP | 2020111792 | A | | 7/2020 |
| JP | 2021038431 | A | | 3/2021 |

OTHER PUBLICATIONS

English language machine translation of CN-106583449-A. Generated Jun. 5, 2026. (Year: 2026).*
English language machine translation of JP-2001335997-A. Generated Jun. 5, 2026. (Year: 2026).*
Jul. 12, 2022, International Search Report issued in the International Patent Application No. PCT/JP2022/022363.
May 13, 2026, Office Action issued by the China National Intellectual Property Administration in the corresponding Chinese Patent Application No. 202280057421.0 with English language search report.

* cited by examiner

FERRITIC STAINLESS STEEL SHEET AND PRODUCTION METHOD THEREFOR

TECHNICAL FIELD

The present disclosure relates to a ferritic stainless steel sheet and a production method therefor.

BACKGROUND

Ferritic stainless steel sheets are widely used in parts that are easily visible, such as the outer panels of sinks and refrigerators and the interior of buildings. Ferritic stainless steel sheets for such uses are therefore required to have excellent design.

As ferritic stainless steel sheets proposed with emphasis on design, for example, JP 2017-179519 A (PTL 1) discloses "A stainless steel sheet excellent in corrosion resistance, comprising polishing marks in one longitudinal direction on a ferritic stainless steel sheet surface, wherein a pitting corrosion potential is 0.6 V or more, a 60-degree glossiness is 75 or less, a composition contains C: 0.020 mass % or less, Si: 0.40 mass % or less, Mn: 0.40 mass % or less, Cr: 25.00 mass % to 32.00 mass %, Mo: 1.00 mass % to 4.00 mass %, P: 0.030 mass % or less, S: 0.020 mass % or less, Ni: 0.50 mass % or less, and N: 0.020 mass % or less with a balance consisting of Fe and inevitable impurities, and a pitting corrosion resistance index (PI=Cr mass %+3Mo mass %) is 30 or more".

JP 2001-335997 A (PTL 2) discloses "A design stainless steel sheet having high whiteness and anti-glare property, wherein a surface glossiness of at least one side is 20 or less in 60-degree specular glossiness defined in JIS Z 8741, and a lightness is 70 or more in L* value defined in JIS Z 8731".

JP 2020-111792 A (PTL 3) discloses "A ferritic stainless steel sheet comprising a chemical composition containing, in mass %, C: 0.020% to 0.120%, Si: 0.10% to 1.00%, Mn: 0.10% to 1.00%, Ni: 0.01% to 0.60%, Cr: 14.00% to 19.00%, N: 0.010% to 0.050%, Al: 0% to 0.050%, Ti: 0% to 0.050%, Mo: 0% to 0.50%, Cu: 0% to 0.50%, Co: 0% to 0.10%, and V: 0% to 0.20%, and one or more selected from the group consisting of Al: 0.005% to 0.030% and Ti: 0.005% to 0.030%, with a balance consisting of Fe and inevitable impurities, and having a γmax value defined by the following formula (1) of 30 to 55, wherein a 20-degree specular glossiness of a steel sheet surface is 900 or more, and an elongation after fracture in a rolling direction is 28.0% or more, $$\gamma max = 420C - 11.5Si + 7Mn + 23Ni - 11.5Cr - 12Mo + 9Cu - 49Ti - 52Al + 470N + 189 \quad (1)$$

where a content of a corresponding element in mass % is substituted for each element symbol in formula (1), with 0 (zero) being substituted for each element that is not added".

CITATION LIST

Patent Literature

PTL 1: JP 2017-179519 A
PTL 2: JP 2001-335997 A
PTL 3: JP 2020-111792 A

SUMMARY

Technical Problem

Glossiness and whiteness (the degree to which the surface color tone appears relatively white) are often used as design evaluation indexes. In fact, these evaluation indexes are used in the foregoing PTL 1 to PTL 3.

In recent years, however, steel sheets having not only high whiteness but also a high degree of image clearness at which people or objects reflected on the surface are clearly seen (hereafter such property is also referred to as "image clarity") are increasingly highly evaluated for their calm and luxurious appearance.

In this regard, the ferritic stainless steel sheets described in PTL 1 and PTL 2 have high whiteness but low image clarity. The ferritic stainless steel sheet described in PTL 3 has high glossiness and high image clarity but low whiteness.

Thus, the ferritic stainless steel sheets described in PTL 1 to PTL 3 do not have both high whiteness and high image clarity.

It could therefore be helpful to provide a ferritic stainless steel sheet having both high whiteness and high image clarity. It could also be helpful to provide a production method for the ferritic stainless steel sheet.

Solution to Problem

Upon careful examination, we discovered the following.

(a) Glossiness, which is an index used conventionally, reflects the total amount of light reflected within a specific angular range out of the light incident on the steel sheet surface from a specific direction. On the other hand, image clarity is higher when the dispersion of the reflection angle of light regularly reflected (hereafter also referred to as regularly reflected light) out of the light incident on the steel sheet surface from a specific direction is lower, that is, the degree of concentration of the direction of travel of regularly reflected light is higher. Hence, there are instances in which high image clarity cannot be obtained even though glossiness is high, and vice versa. Glossiness is thus not appropriate as an evaluation parameter for image clarity.

(b) As a result of examining an evaluation parameter for image clarity (i.e. the degree of concentration of the direction of travel of regularly reflected light) as an alternative to glossiness, we found that it is appropriate to use the image clarity: C(2.0) defined in JIS K 7374: 2007.

(c) We also investigated the reason why image clarity decreases in steel sheets with high whiteness, as in the stainless steel sheets described in PTL 1 and PTL 2, and consequently discovered the following. Typically, a large amount of light is irregularly reflected on the surface of a steel sheet (hereafter also referred to as "sheet surface") having high whiteness. Hence, from the viewpoint of achieving high whiteness, it is usually intended to reflect incident light in random directions (hereafter also referred to as "randomization"). Consequently, regularly reflected light is also subjected to randomization on the sheet surface with high whiteness, and the degree of concentration of the direction of travel of the regularly reflected light decreases. This results in a decrease in image clarity.

(d) Based on such discoveries, we conducted further study in order to obtain a ferritic stainless steel sheet having both high whiteness and high image clarity. We consequently discovered that it is important to appropriately control the surface texture of the ferritic stainless steel sheet. In detail, it is important that the surface of the steel sheet is made up of "regions with a relatively high height (hereafter also referred to as "plateau portions")" and "regions with a relatively low height (hereafter also referred to as "valley portions")", and their fractions are appropriately adjusted and the plateau portions are flattened (smoothed) while the valley portions are roughened. Specifically, the area ratio of the plateau portions is set to 30% to 70% with the balance being the valley portions (i.e. the area ratio of the valley portions is set to 30% to 70%), and Sdr of the plateau portions is set to 0.100 or less and Sdq of the valley portions is set to 0.20 or more.

Herein, Sdr and Sdq are the developed interfacial area ratio of the scale-limited surface and the root mean square gradient of the scale-limited surface defined in JIS B 0681-2: 2018, respectively.

(e) By controlling the surface texture of the sheet surface in this way, the dispersion of the reflection angle of regularly reflected light decreases and image clarity increases in the plateau portions, whereas incident light is reflected in random directions and whiteness increases in the valley portions. As a result, high whiteness and high image clarity can be achieved simultaneously. The plateau portions are regions whose height is greater than or equal to a threshold calculated from the shape data of the steel sheet surface by the mode method, and the valley portions are regions other than the plateau portions, i.e. regions whose height is less than the threshold. This will be described in detail later.

(f) We produced various ferritic stainless steel sheets and made quantitative design evaluation on their surfaces based on glossiness, whiteness, and image clarity, and consequently noticed that, even if ferritic stainless steel sheets are equal in these indexes, the impression received from the appearance is often different between the ferritic stainless steel sheets. We conducted various studies to determine the reason for this, and found that the difference in impression received from the appearance is caused by the difference in impression received from the noticeability of a grain pattern and streak pattern on the steel sheet surface. For example, steel sheets subjected to dull working using rolls different in surface roughness exhibit similar values in glossiness, whiteness, and image clarity. However, when the surface roughness is lower, the grain pattern on the surface is less noticeable, giving the impression that the surface is fine, that is, the impression of more calm and luxurious appearance. When the surface roughness is higher, on the other hand, the grain pattern on the surface is more noticeable, giving the impression that the surface is rough.

Hereafter, the grain pattern and streak pattern are also referred to as "surface roughness", the state in which surface roughness is less noticeable as "fine", and the state in which surface roughness is more noticeable as "rough". Moreover, the degree to which surface roughness is not noticeable is also referred to as "surface roughness resistance", and the state in which surface roughness is not noticeable as "excellent surface roughness resistance".

(g) The surface roughness resistance may differ even when the indexes such as glossiness, whiteness, and image clarity are similar. In other words, the surface roughness resistance cannot be evaluated using these indexes. This is because the degree of surface roughness depends on the location-by-location fluctuation (difference) in light reflection characteristics (for example, the amount of regularly reflected light and the amount of irregularly reflected light) in minute regions. In detail, glossiness and whiteness are average values of specific light reflection characteristics of the steel sheet surface in a specific measurement region. Accordingly, however the light reflection characteristics in each minute region fluctuate (i.e. however the light reflection characteristics vary between minute regions), such fluctuation does not influence the characteristic values of glossiness and whiteness.

(h) In view of this, we repeatedly studied parameters that enable quantitative evaluation of the surface roughness resistance, and discovered the following.

The degree of surface roughness of the sheet surface is influenced by the foregoing location-by-location fluctuation in light reflection characteristics in minute regions, in particular, the period of fluctuation within the sheet surface (i.e. the value indicating the length (cycle) by which a part with a large amount of regularly reflected light and a part with a small amount of regularly reflected light alternate in the in-plane direction of the sheet surface, or the value indicating the length (cycle) by which a part with a large amount of irregularly reflected light and a part with a small amount of irregularly reflected light alternate within the sheet surface). In particular, in the case where there are a plurality of types of location-by-location fluctuations in light reflection characteristics with different periods in various directions on the sheet surface, the period of the location-by-location fluctuation in light reflection characteristics that is particularly noticeable, especially the period of the location-by-location fluctuation in light reflection characteristics whose period is longest (hereafter also referred to as the "longest period of location-by-location fluctuation in light reflection characteristics") of the plurality of types of location-by-location fluctuations in light reflection characteristics significantly influences the surface roughness resistance of the sheet surface. For example, when the longest period of location-by-location fluctuation in light reflection characteristics is longer, the surface roughness of the sheet surface is more noticeable. When the longest period of location-by-location fluctuation in light reflection characteristics is shorter, the surface roughness of the sheet surface is less noticeable and the sheet surface appears more even (i.e. finer).

(i) Based on such discoveries, we considered the possibility that the surface roughness resistance of the sheet surface can be quantitatively evaluated by quantifying the longest period of location-by-location fluctuation in light reflection characteristics, and further investigated the method for this. We consequently discovered that the surface roughness resistance of the sheet surface can be quantitatively evaluated by the "maximum autocorrelation length" obtained by numerically analyzing a photographic image of the sheet surface, and excellent surface roughness resistance (and therefore an appearance giving a more calm and luxurious impression) is obtained especially in the case where the maximum autocorrelation length is 50 μm or less. In visual evaluation of appearance by inhouse evaluators other than us, all inhouse evaluators evaluated the sheet surface as giving a more calm and luxurious impression (rated first or second on a 5-point scale) in the case where the maximum autocorrelation length was 50 μm or less.

(j) Herein, the "maximum autocorrelation length" is a value that, in an autocorrelation image obtained by performing image processing on a microscopic image of the steel sheet surface by a coaxial epi-illumination method, is obtained by dividing, by 2, the absolute maximum length of a region that includes the center of the image and whose pixels have luminance values greater than or equal to a reference value. Specifically, the maximum autocorrelation length is calculated in the following manner.

First, the steel sheet surface is imaged by a coaxial epi-illumination method to obtain a microscopic image of the steel sheet surface (hereafter also referred to as "sheet surface image"). The coaxial epi-illumination method is a microscopic method in which the optical axis of the illumination applied to the sample to be observed and the optical axis of the objective lens are aligned, the illumination is applied to the sample to be observed from the direction of the objective lens, and the reflected light from the sample to be observed is focused by the objective lens to form an image. The pixel resolution value of the sheet surface image is 5 μm/pix or less (i.e. one side length of one pixel corresponds to the actual length of 5 μm or less of the object to be photographed), and the observation field size is 4 mm square or more.

The obtained sheet surface image is then subjected to image processing. Although the following description assumes that the sheet surface image is obtained as a color image (five-dimensional information expressed by x: horizontal position, y: vertical position, R: luminance value (red), G: luminance value (green), and B: luminance value (blue)), in the case where the sheet surface image is obtained as a monochrome image (three-dimensional information expressed by x: horizontal position, y: vertical position, and L: luminance value), the below-described gray scale conversion procedure is omitted. The luminance value denotes the brightness of each pixel (x, y) constituting the image. First, the sheet surface image is subjected to gray scale conversion (i.e. a process of averaging the R, G, and B values at each (x, y) position of the color image and setting the obtained value as L to convert the image into a monochrome image). Following this, shading (the difference in luminance value between locations within the image caused by the optical system of the photographing device. In a microscopic image formed by the coaxial epi-illumination method, typically the luminance value is high at the center of the image and low at the outer periphery of the image.) is removed from the image using a low-cut filter. Next, the average value of the luminance values of all pixels constituting the sheet surface image is subtracted from each pixel, to set the average value of the luminance values of all pixels constituting the sheet surface image to 0. This causes the luminance values of some of the pixels to be negative values. The converted image is subjected to fast Fourier transform (based on a conversion algorithm implemented in FFTPACK), and then converted into a power spectrum image. The conversion into the power spectrum image is carried out by multiplying the value (complex number after fast Fourier transform) of each pixel by the complex conjugate number of the value and then raising the obtained value to the ½ power. The obtained power spectrum image is then subjected to inverse fast Fourier transform (based on a conversion algorithm implemented in FFTPACK), and the imaginary part of each pixel of the obtained image is deleted, leaving only the real part. The value of each pixel is then divided by the value of the pixel whose value is highest in the image and thus normalized, as a result of which an autocorrelation image is obtained. The obtained autocorrelation image is an image in which the luminance value at the center of the image is highest. Following this, in the obtained autocorrelation image, only pixels whose luminance values are 0.02 or more are extracted. From the extracted pixels, only a region including the center of the image is extracted using the four-connection method (method that regards pixels adjacent on at least one of the upper, lower, right, and left sides as the same region), and taken to be a region to be analyzed. The absolute maximum length of the region to be analyzed (i.e. the longest line segment that cuts the region to be analyzed into two) is then measured, and divided by 2 to obtain the maximum autocorrelation length.

The foregoing measurement is performed on one stainless steel sheet having a size of 50 mm square or more for randomly selected ten observation fields, and the arithmetic mean value of the maximum autocorrelation lengths calculated for the respective observation fields is taken to be the maximum autocorrelation length of the stainless steel sheet.

(j) We produced various stainless steel sheets and quantitatively evaluated the surface roughness resistance by the maximum autocorrelation length for their surfaces. As a result, we discovered that, in addition to employing the foregoing structure of plateau portions and valley portions, setting Sal to 50 μm or less and Str to 0.3 or more as the surface texture of the sheet surface makes it possible to obtain excellent surface roughness resistance (appearance giving a more calm and luxurious impression) while ensuring high whiteness and high image clarity.

Herein, Sal and Str are the autocorrelation length and texture aspect ratio defined in JIS B 0681-2: 2018, respectively.

(l) We also repeatedly studied the method of producing the foregoing stainless steel sheet, and discovered the following three suitable methods: "dull rolling nitrohydrochloric acid electrolysis method", "dull rolling mixed acid immersion method", and "mixed acid pickling single method".

(m) In the dull rolling nitrohydrochloric acid electrolysis method and the dull rolling mixed acid immersion method, as illustrated in FIG. 1, irregularities (i.e. concave and convex portions) (hereafter also simply referred to as "irregularities" or "valley-plateau irregularities" in order to be distinguished from the below-described fine irregularities) serving as valley portions and plateau portions are formed on the sheet surface by cold rolling. Following this, fine irregularities are formed on the sheet surface by pickling to roughen the valley portions. Next, by skin pass rolling, the convex portions of the irregularities formed by cold rolling are leveled to form plateau portions, and simultaneously the fine irregularities of the plateau portions are flattened to thus obtain a stainless steel sheet having the foregoing surface texture.

(n) In the mixed acid pickling single method, as illustrated in FIG. 2, a blank steel sheet whose surface has been smoothed in advance is pickled by immersion treatment in a nitric hydrofluoric acid aqueous solution (hereafter also referred to as "mixed acid") to form irregularities (i.e. concave and convex portions) on the sheet surface, and simultaneously fine irregularities are formed on the sheet surface to roughen the valley portions. Next, by skin pass rolling, the convex portions of the irregularities formed by pickling are leveled to form plateau portions, and simultaneously the fine irregularities of the plateau portions are flattened to thus obtain a stainless steel sheet having the foregoing surface texture.

(o) The mixed acid pickling single method not only has excellent productivity but also is advantageous in obtaining excellent surface roughness resistance compared to the dull rolling nitrohydrochloric acid electrolysis method and the dull rolling mixed acid immersion method. In detail, when pickling is performed by immersion treatment in the mixed acid, the amount of dissolution differs depending on the crystal orientation of each crystal grain in the steel sheet, so that irregularities whose period is on the order of crystal grain size, reflecting the crystal microstructure of the steel sheet, are formed on the steel sheet surface. Such irregularities have a shorter period than the irregularities imparted by cold rolling in the dull rolling nitrohydrochloric acid electrolysis method and the dull rolling mixed acid immersion method. The period of the irregularities correlates with the longest period of location-by-location fluctuation in light reflection characteristics which influences the surface roughness resistance. Therefore, in the stainless steel sheet produced by the mixed acid pickling single method, the longest period of location-by-location fluctuation in light reflection characteristics is shorter than that in the stainless steel sheet produced by the dull rolling nitrohydrochloric acid electrolysis method or the dull rolling mixed acid immersion method, so that better surface roughness resistance is obtained. Pickling by immersion treatment in the mixed acid is also performed in the dull rolling mixed acid immersion method. However, since the irregularities imparted by cold rolling are longer in period than the irregularities imparted by such pickling, not the irregularities imparted by pickling by immersion treatment in the mixed acid but the irregularities imparted by cold rolling are the governing factor for the surface roughness resistance in the steel sheet produced by the dull rolling mixed acid immersion method. Hence, the steel sheet produced by the mixed acid pickling single method has better surface roughness resistance than the steel sheet produced by the dull rolling mixed acid immersion method.

The present disclosure is based on these discoveries and further studies. We thus provide:

1. A ferritic stainless steel sheet, wherein a surface of the ferritic stainless steel sheet is made up of plateau portions and valley portions, an area ratio of the plateau portions is 30% to 70%, Sdr of the plateau portions is 0.100 or less, and Sdq of the valley portions is 0.20 or more, and Sal is 50 μm or less, and Str is 0.30 or more, where Sdr, Sdq, Sal, and Str are a developed interfacial area ratio of scale-limited surface, a root mean square gradient of scale-limited surface, an autocorrelation length, and a texture aspect ratio defined in JIS B 0681-2: 2018, respectively.
2. The ferritic stainless steel sheet according to 1., wherein L* is 50 or more, and C(2.0) is 10% or more, and a maximum autocorrelation length is 50 μm or less, where L* is a lightness index defined in JIS Z 8781-4: 2013, C(2.0) is an image clarity defined in JIS K 7374: 2007, and the maximum autocorrelation length is a value that, in an autocorrelation image obtained by performing image processing on a microscopic image of a surface of the stainless steel sheet by a coaxial epi-illumination method, is obtained by dividing, by 2, an absolute maximum length of a region that includes a center of the image and whose pixels have luminance values greater than or equal to a reference value.
3. The ferritic stainless steel sheet according to 1. or 2., wherein Sal is 20 μm or less, and Str is 0.45 or more.
4. The ferritic stainless steel sheet according to 3., wherein the maximum autocorrelation length is 35 μm or less.
5. A production method for the ferritic stainless steel sheet according to 1. or 2., the production method comprising: preparing a material for cold rolling; thereafter cold rolling the material for cold rolling to obtain a cold-rolled steel sheet; thereafter annealing the cold-rolled steel sheet to obtain a cold-rolled and annealed steel sheet; thereafter pickling the cold-rolled and annealed steel sheet; and thereafter skin pass rolling the cold-rolled and annealed steel sheet, wherein in the cold rolling, a dull roll having Ra of 1.00 μm or more, Sal of 50.0 μm or less, and Str of 0.30 or more is used in a final pass, and a rolling reduction ratio in the final pass is 0.80% or more, in the pickling, positive electrolytic treatment is performed under treatment conditions that a treatment solution is a nitrohydrochloric acid aqueous solution having a hydrochloric acid concentration of 0.10 mass % to 5.00 mass % and a nitric acid concentration of 10.0 mass % to 20.0 mass %, a treatment temperature is 30° C. to 65° C., a treatment time is 1.0 second to 60.0 seconds, and a current density is 5.0 $A/dm^2$ to 20.0 $A/dm^2$, and in the skin pass rolling, a dull roll having Ra of 0.30 μm or less is used, and an elongation ratio is 0.10% to 3.00%, where Sal and Str are an autocorrelation length and a texture aspect ratio defined in JIS B 0681-2: 2018, respectively, and Ra is an arithmetic mean roughness defined in JIS B 0601: 2013.
6. A production method for the ferritic stainless steel sheet according to 1. or 2., the production method comprising: preparing a material for cold rolling; thereafter cold rolling the material for cold rolling to obtain a cold-rolled steel sheet; thereafter annealing the cold-rolled steel sheet to obtain a cold-rolled and annealed steel sheet; thereafter pickling the cold-rolled and annealed steel sheet; and thereafter skin pass rolling the cold-rolled and annealed steel sheet, wherein in the cold rolling, a dull roll having Ra of 1.00 μm or more, Sal of 50.0 μm or less, and Str of 0.30 or more is used in a final pass, and a rolling reduction ratio in the final pass is 0.80% or more, in the pickling, immersion treatment is performed under treatment conditions that a treatment solution is a mixed acid aqueous solution having a hydrofluoric acid concentration of 1.0 mass % to 8.0 mass % and a nitric acid concentration of 2.0 mass % to 12.0 mass %, a treatment temperature is 30° C. to 65° C., and a treatment time is 25 seconds to 600 seconds, and in the skin pass rolling, a dull roll having Ra of 0.30 μm or less is used, and an elongation ratio is 0.10% to 3.00%, where Sal and Str are an autocorrelation length and a texture aspect ratio defined in JIS B 0681-2: 2018, respectively, and Ra is an arithmetic mean roughness defined in JIS B 0601: 2013.
7. A production method for the ferritic stainless steel sheet according to any one of 1. to 4., the production method comprising: preparing a blank steel sheet; thereafter annealing the blank steel sheet to obtain an annealed steel sheet; thereafter pickling the annealed steel sheet; and thereafter skin pass rolling the annealed steel sheet, wherein the blank steel sheet has Ra of 0.20 μm or less and RSm of 50.0 μm or less, in the pickling, immersion treatment is performed under treatment conditions that a treatment solution is a mixed acid aqueous solution having a hydrofluoric acid concentration of 1.0 mass % to 8.0 mass % and a nitric acid concentration of 2.0 mass % to 12.0 mass %, a treatment temperature is 30° C. to 65° C., and a treatment time is 25 seconds to 600 seconds, and in the skin pass rolling, a dull roll having Ra of 0.09 μm or less is used, and an elongation ratio is 0.10% to 1.50%, where Ra and RSm are an arithmetic mean roughness and a mean width of roughness profile elements defined in JIS B 0601: 2013, respectively.

8. The production method according to 7., wherein the blank steel sheet has Ra of 0.15 μm or less and RSm of 25.0 μm or less.

Advantageous Effect

It is thus possible to obtain a ferritic stainless steel sheet having both high whiteness and high image clarity and also having excellent surface roughness resistance (appearance giving a more calm and luxurious impression).

DETAILED DESCRIPTION

Figure 1:
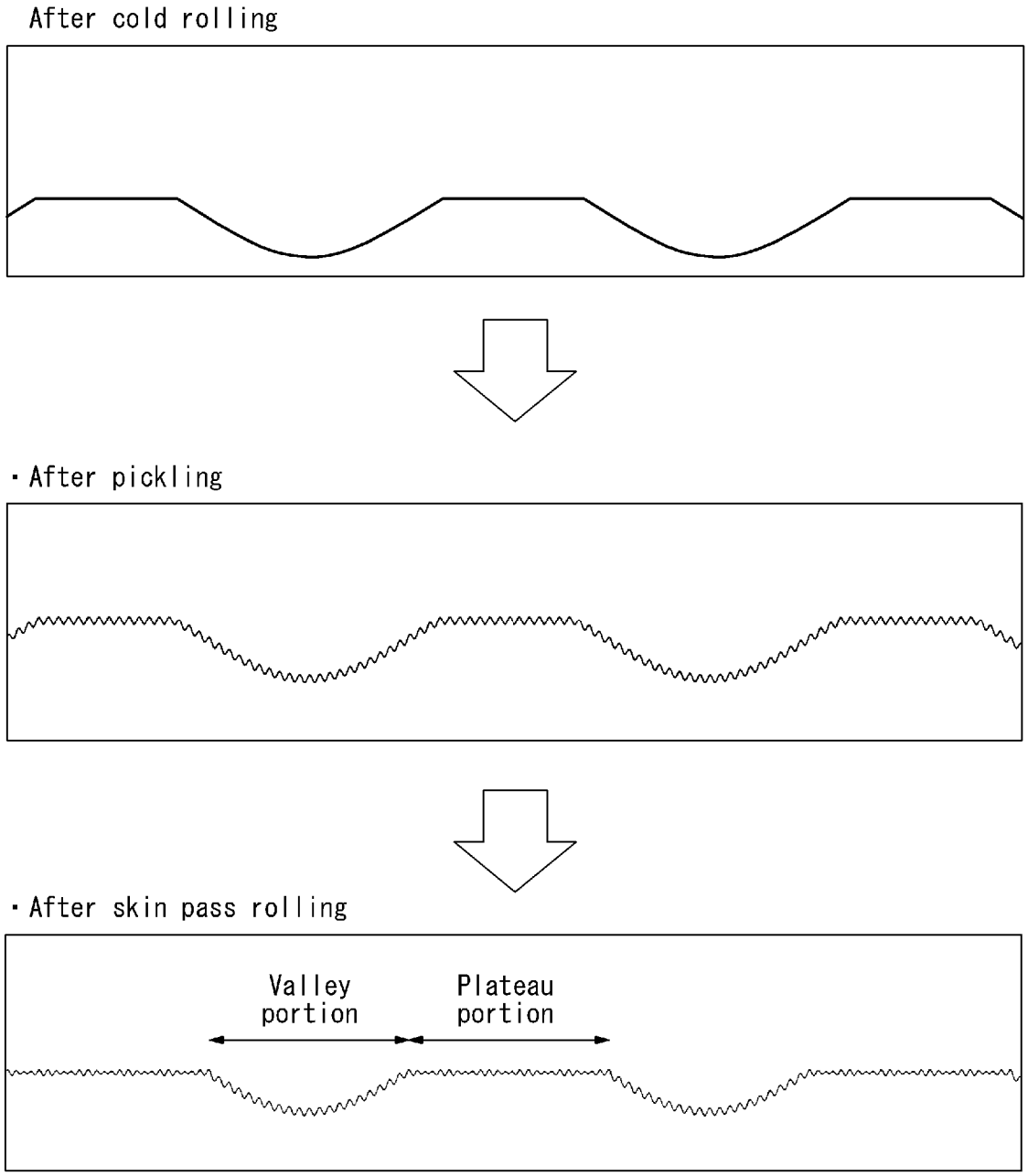
FIG. 1 is a schematic diagram illustrating the surface state of a stainless steel sheet produced by the dull rolling nitrohydrochloric acid electrolysis method and the dull rolling mixed acid immersion method.
Figure 2:
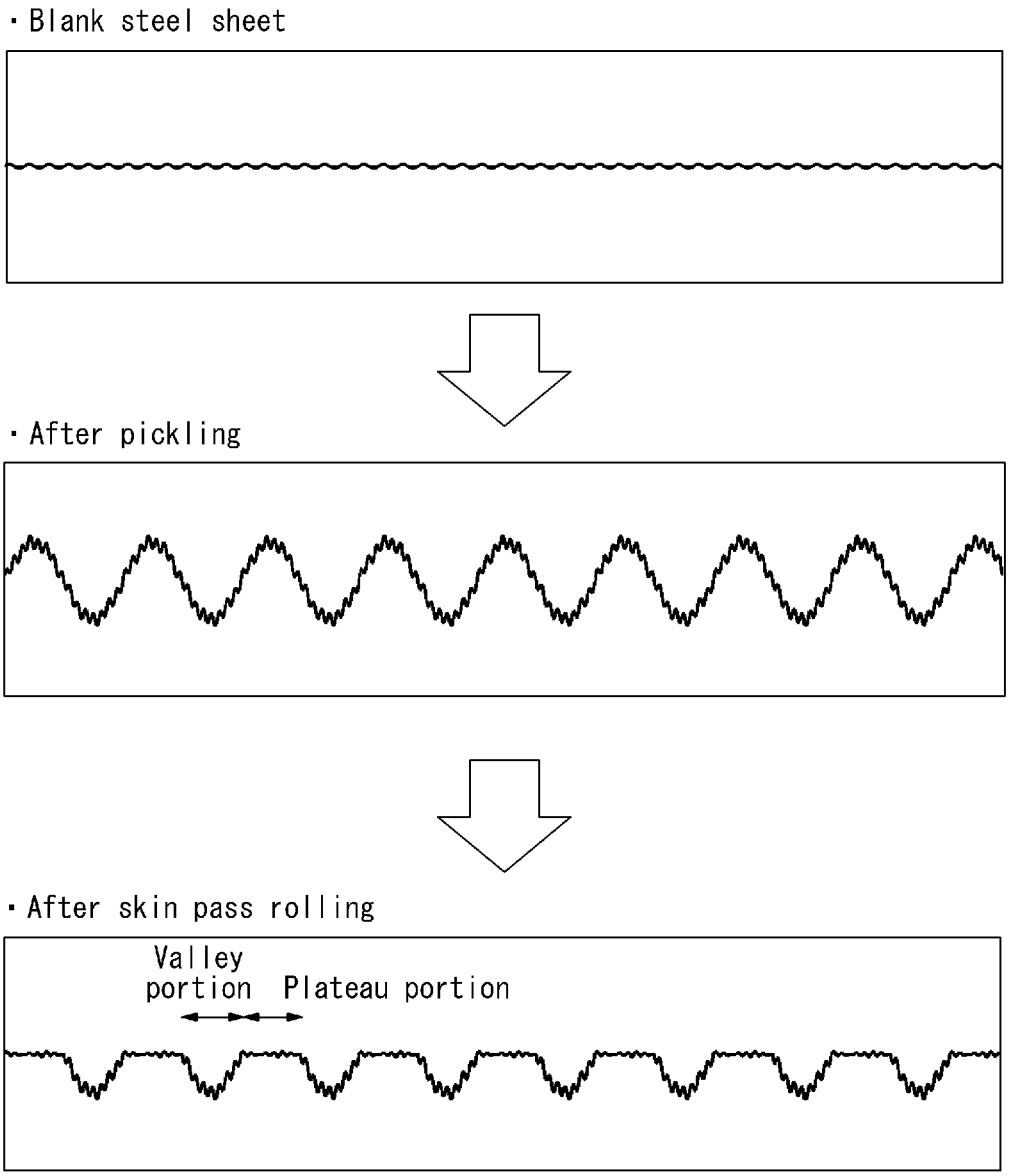
FIG. 2 is a schematic diagram illustrating the surface state of a stainless steel sheet produced by the mixed acid pickling single method.

The presently disclosed techniques will be described by way of embodiments below.

[1] Ferritic Stainless Steel Sheet

A ferritic stainless steel sheet according to an embodiment of the present disclosure is a ferritic stainless steel sheet whose surface is made up of plateau portions and valley portions, wherein an area ratio of the plateau portions is 30% to 70%, Sdr of the plateau portions is 0.100 or less, Sdq of the valley portions is 0.20 or more, Sal is 50 μm or less, and Str is 0.30 or more, where Sdr, Sdq, Sal, and Str are the developed interfacial area ratio of the scale-limited surface, the root mean square gradient of the scale-limited surface, the autocorrelation length, and the texture aspect ratio defined in JIS B 0681-2: 2018, respectively.

Herein, "ferritic" means having a microstructure mainly composed of ferrite phase, specifically, a microstructure composed of ferrite phase with an area ratio of 80% or more, preferably 90% or more, and more preferably 95% or more to the entire microstructure and residual microstructure (i.e. microstructure other than ferrite phase). Examples of the residual microstructure include martensite phase and retained austenite phase. The microstructure may be ferrite single phase (the area ratio of ferrite phase to the entire microstructure is 100%).

The area ratio of ferrite phase is measured in the following manner. A test piece for cross-sectional observation is prepared from a stainless steel sheet as a sample material. After this, the test piece is etched with aqua regia, and then observed for ten observation fields using an optical microscope with 200 magnification. From the microstructure shapes and etching strengths, martensite phase, ferrite phase, and retained austenite phase are distinguished from each other. Subsequently, the area ratio of ferrite phase is determined for each observation field by image processing, and the arithmetic mean value of the ten observation fields is calculated.

In the ferritic stainless steel sheet according to an embodiment of the present disclosure, it is important that:

the sheet surface is made up of plateau portions and valley portions, their fractions are appropriately adjusted, and the plateau portions are flattened whereas the valley portions are roughened, and Sal is 50 μm or less, and Str is 0.30 or more.

Area Ratio of Plateau Portions: 30% to 70%

In the ferritic stainless steel sheet according to an embodiment of the present disclosure, the plateau portions are flattened (i.e. the surface undulations of the plateau portions are reduced) to reduce the dispersion of the reflection angle of regularly reflected light on the plateau portions and enhance the image clarity of the steel sheet. If the area ratio of the plateau portions is less than 30%, the total amount of reflected light on the plateau portions of the steel sheet decrease and the total amount of reflected light on the valley portions increases. In this case, due to irregularly reflected light on the valley portions, the dispersion of the reflection angle of regularly reflected light increases and the image clarity of the steel sheet decreases. If the area ratio of the plateau portions is more than 70%, the area ratio of the valley portions decreases and high whiteness cannot be obtained. The area ratio of the plateau portions is therefore 30% to 70%. The area ratio of the plateau portions is preferably 40% or more. The area ratio of the plateau portions is preferably 60% or less.

Since the surface of the ferritic stainless steel sheet according to an embodiment of the present disclosure is made up of plateau portions and valley portions, the balance other than the plateau portions consists of valley portions. That is, the area ratio of the valley portions is 30% to 70%. The area ratio of the valley portions is preferably 40% or more. The area ratio of the valley portions is preferably 60% or less.

Sdr of Plateau Portions: 0.100 or Less

Sdr is an index indicating the degree of surface undulation. That is, a small value of Sdr of the plateau portions means that the surface undulations of the plateau portions are small. In other words, the direction in which light incident from a specific direction is regularly reflected on the plateau portions is likely to be concentrated. If Sdr of the plateau portions is 0.100 or less, high image clarity can be obtained. Sdr of the plateau portions is therefore 0.100 or less. Sdr of the plateau portions is preferably 0.050 or less. Although no lower limit is placed on Sdr of the plateau portions, Sdr of the plateau portions is preferably 0.010 or more.

Sdq of Valley Portions: 0.20 or More

Sdq is an index indicating the magnitude of the slope of each minute region of the surface. That is, a large value of Sdq of the valley portions means that each minute region of the valley portions has a large slope at each location. In other words, light incident on the valley portions from a specific direction is likely to be reflected in various directions (randomized). If Sdq of the valley portions is 0.20 or more, high whiteness can be obtained. Sdq of the valley portions is therefore 0.20 or more. Sdq of the valley portions is preferably 0.40 or more. Although no upper limit is placed on Sdq of the valley portions, Sdq of the valley portions is preferably 0.80 or less.

Sal: 50 μm or Less, and Str: 0.30 or More

An effective way of reducing the surface roughness of the sheet surface is to shorten the period of location-by-location fluctuation in light reflection characteristics within the sheet surface, in particular, shorten the period of surface irregularities with large height differences. For example, the surface roughness is less noticeable when concave portions and convex portions alternate on the surface in 0.1 mm cycles than when concave portions and convex portions alternate on the surface in 1 mm cycles. As mentioned above, the longest period of location-by-location fluctuation in light reflection characteristics is a main determinant of the surface roughness. Sal is an index that reflects the period of surface irregularities in the direction in which the period of surface irregularities is shortest within the sheet surface. Str is an index that reflects the ratio between the period of surface irregularities in the direction in which the period of surface irregularities is shortest and the period of surface irregularities in the direction in which the period of surface irregularities is longest ((the period of surface irregularities in the direction in which the period of surface irregularities is shortest)/(the period of surface irregularities in the direction in which the period of surface irregularities is longest) (i.e. the longest period of location-by-location fluctuation in light reflection characteristics)) within the sheet surface. By reducing Sal and increasing Str, the longest period of location-by-location fluctuation in reflection characteristics can be substantially reduced to thus obtain excellent surface roughness resistance.

If Sal is more than 50 μm or Str is less than 0.30, the surface roughness of the sheet surface is noticeable and the surface roughness resistance is insufficient. It is therefore necessary to set Sal to 50 μm or less and Str to 0.30 or more. Sal is preferably 40 μm or less, and more preferably 20 μm or less. Although no lower limit is placed on Sal, Sal is preferably 5 μm or more. Str is more preferably 0.45 or more. Although no upper limit is placed on Str, Str is preferably 0.80 or less. Particularly preferably, Sal is 20 μm or less and Str is 0.45 or more.

The area ratio of the plateau portions, the area ratio of the valley portions, Sdr of the plateau portions, Sdq of the valley portions, Sal, and Str are each measured as follows.

First, the surface of a stainless steel sheet as a sample material is photographed for a plurality of observation fields using a confocal laser microscope with a 50-power objective lens. The obtained photographic data is then connected to obtain three-dimensional shape data (hereafter simply referred to as "shape data" or "data") of a region of 500 μm square or more. Here, data for one observation field is obtained by measuring the shape of a range of 290 μm in width and 218 μm in length with 2048×1536 pixels. Usually, data compression is performed when connecting photographic data from the viewpoint of analysis efficiency. However, since data compression makes it impossible to accurately evaluate each surface texture parameter, data compression is not performed here. Next, noise is removed from the obtained shape data (i.e. removal of spikes and missing points inevitably mixed into the shape data measured by confocal laser microscopy. In the case of removing missing points, the height data of the missing points is interpolated from surrounding pixels.). Following this, tilt correction is performed by approximating a 500 μm square region at the center of the data with a plane and taking the difference. Next, the average value of the shape data of all pixels included in the region is subtracted to set a reference plane. The heights of the pixels removed as noise may be interpolated based on the heights of surrounding pixels.

Next, the 500 μm square region at the center of the tilt-corrected data is separated into plateau portions and valley portions based on the height data corresponding to each pixel in the region. First, a height threshold is calculated by the mode method based on the frequency distribution of height data in the region. The regions whose heights are greater than or equal to the threshold are determined as plateau portions, and the other regions (regions whose heights are less than the threshold) as valley portions. The respective area ratios of the plateau portions and the valley portions are then calculated.

Herein, the mode method refers to a height threshold calculation method of detecting between the peaks in the frequency distribution of height data and determining the height value of the boundary between the detected peaks in the frequency distribution as a threshold.

Specifically, the threshold is determined by the following procedure. First, the heights within the target 500 μm square region are divided in 256 levels of frequency, and then the frequency distribution F( ) is determined. Let F(h) be the frequency at height h. Next, while changing h from the minimum height to the maximum height in the target 500 μm square region, the value of (F(h_low)−F(h))×(F(h_high)−F(h)) is calculated for each h, where h_low is a height that is lower than h and at which frequency F( ) is maximum, and h_high is a height that is higher than h and at which frequency F( ) is maximum. Height h at which the value of (F(h_low)−F(h))×(F(h_high)−F(h)) is maximum is taken to be the threshold.

Sdr of the plateau portions is measured in the following manner.

Only the three-dimensional shape data of the region of plateau portions defined as described above is extracted, and the tilt correction of the shape data and the reference plane setting are performed in the same manner as above. Next, a 2.5 μm S filter (low pass filter) is applied to calculate Sdr in the plateau portion range in accordance with JIS B 0681-2: 2018, without an L filter (high pass filter) and additional shape correction.

Sdq of the valley portions is measured in the following manner.

Only the three-dimensional shape data of the region of valley portions defined as described above is extracted, and the tilt correction of the shape data and the reference plane setting are performed in the same manner as above. Next, a 2.5 μm S filter (low pass filter) is applied to calculate Sdq in the valley portion range in accordance with JIS B 0681-2: 2018, without an L filter (high pass filter) and additional shape correction.

Sal and Str are measured in the following manner.

Using the tilt-corrected data and reference plane setting obtained when separating the plateau portions and the valley portions, a 2.5 μm S filter (low pass filter) is applied to calculate Sal and Str in accordance with JIS B 0681-2: 2018 for the 500 μm square region at the center of the data, without an L filter (high pass filter) and additional shape correction.

Herein, "high whiteness" means that the lightness index L* (hereafter also simply referred to as "L*") defined in JIS Z 8781-4: 2013 is 50 or more. L* is preferably 55 or more, and more preferably 60 or more. Although no upper limit is placed on L*, L* is preferably 70 or less.

Specifically, L* is measured in the following manner. Color measurement is performed in accordance with JIS Z 8722: 2009 so that the rolling direction (L direction) of the stainless steel sheet will be the measurement direction. The observation field is 10 degrees, the light source is D65, and the color system is CIELAB (L*a*b* system). The measured value obtained by measurement under condition c (de: 8°) (SCE condition) is taken to be L*.

Herein, "high image clarity" means that the image clarity C(2.0) (hereafter also simply referred to as "C(2.0)") defined in JIS K 7374: 2007 is 10% or more. C(2.0) is preferably 50% or more. Particularly preferably, L* is 60 or more and C(2.0) is 50% or more. Although no upper limit is placed on C(2.0), C(2.0) is preferably 95% or less.

Specifically, C(2.0) is measured in the following manner. The image clarity (%) is measured by a reflection method in accordance with JIS K 7374: 2007. The measurement direction is the rolling direction (L direction) of the stainless steel sheet. That is, the rolling direction (L direction) and the optical mask are orthogonal to each other. The measurement angle is 60 degrees, and the optical mask line width is 2.0 mm. The obtained image clarity (%) is taken to be C(2.0).

Herein, "excellent surface roughness resistance" means that the maximum autocorrelation length is 50 μm or less. The maximum autocorrelation length is preferably 35 μm or less. Although no lower limit is placed on the maximum autocorrelation length, the maximum autocorrelation length is preferably 5 μm or more. The definition and measurement method of the maximum autocorrelation length are as described above.

The surface of the ferritic stainless steel sheet on at least one side has the foregoing surface texture and characteristics. Preferably, the surface of the ferritic stainless steel sheet on both sides has the foregoing surface texture and characteristics.

The thickness of the stainless steel sheet according to an embodiment of the present disclosure (hereafter also referred to as "sheet thickness") is not limited, but is preferably 0.1 mm or more from the viewpoint of productivity. The sheet thickness is preferably 4.0 mm or less. The sheet thickness is more preferably 0.5 mm or more, and further preferably 1.0 mm or more. The sheet thickness is more preferably 3.0 mm or less, and further preferably 2.0 mm or less.

The chemical composition of the stainless steel sheet according to an embodiment of the present disclosure is not limited, but is preferably the following first chemical composition or second chemical composition, for example.

First Chemical Composition

The first chemical composition contains, in mass %, C: 0.001% to 0.150%, Si: 0.01% to 2.00%, Mn: 0.01% to 1.00%, P: 0.050% or less, S: 0.040% or less, Ni: 0.01% to 2.50%, Cr: 10.5% to 32.0%, Al: 0.001% to 6.5%, and N: 0.001% to 0.100%, and optionally one or more groups selected from the following (group A) to (group C), with the balance consisting of Fe and inevitable impurities.

(group A): one or more selected from Cu: 2.00% or less, Co: 2.00% or less, Mo: 3.00% or less, and W: 2.00% or less.

(group B): one or more selected from Ti: 0.50% or less, Nb: 1.00% or less, V: 0.50% or less, and Zr: 0.50% or less.

(group C) one or more selected from B: 0.0050% or less, Mg: 0.0050% or less, Ca: 0.0030% or less, Y: 0.20% or less, REM (rare earth metal): 0.20% or less, Sn: 0.50% or less, and Sb: 0.50% or less.

The first chemical composition will be described below. The first chemical composition is particularly suitable for use in the production method by the below-described dull rolling nitrohydrochloric acid electrolysis method and dull rolling mixed acid immersion method.

C: 0.001% to 0.150%

C has the effect of, as a result of dissolving in the steel, increasing the strength of the steel sheet to suppress scratches during production and enhance the productivity of the steel sheet. If the C content is less than 0.001%, the effect is insufficient. If the C content is more than 0.150%, defects caused by carbides are likely to occur on the surface of the steel sheet, causing a decrease in the productivity of the steel sheet. The C content is therefore preferably in the range of 0.001% to 0.150%. The C content is more preferably 0.010% or more, and further preferably 0.030% or more. The C content is more preferably 0.100% or less, and further preferably 0.050% or less.

Si: 0.01% to 2.00%

Si is an element that acts as a deoxidizer during steelmaking to reduce inclusions in the steel that cause surface defects in the steel sheet and enhance the productivity of the steel sheet. Si also has the effect of increasing the strength of the steel sheet to suppress scratches during production and enhance the productivity of the steel sheet. To achieve these effects, the Si content is preferably 0.01% or more. If the Si content is more than 2.00%, defects caused by inclusions are likely to occur on the surface of the steel sheet, causing a decrease in the productivity of the steel sheet. The Si content is therefore preferably in the range of 0.01% to 2.00%. The Si content is more preferably 0.10% or more, and further preferably 0.20% or more. The Si content is more preferably 1.00% or less, and further preferably 0.70% or less.

Mn: 0.01% to 1.00%

Mn has the effect of increasing the strength of the steel sheet to suppress scratches during production and enhance the productivity of the steel sheet. To achieve this effect, the Mn content is preferably 0.01% or more. If the Mn content is more than 1.00%, MnS is likely to form in the steel, which may serve as a corrosion initiation point and cause a decrease in the corrosion resistance of the steel sheet. The Mn content is therefore preferably in the range of 0.01% to 1.00%.

P: 0.050% or Less

P is an element that embrittles the steel, thus promoting cracking of the surface of the steel sheet and causing a decrease in the productivity of the steel sheet. Accordingly, it is desirable to reduce the P content as much as possible. The P content is therefore preferably 0.050% or less. The P content is more preferably 0.040% or less. Although no lower limit is placed on the P content, excessive dephosphorization leads to higher production costs. The P content is therefore preferably 0.010% or more.

S: 0.040% or Less

S is an element that exists in the steel as sulfide-based inclusions such as MnS and facilitates surface defects caused by inclusions, causing a decrease in the productivity of the steel sheet. Accordingly, it is desirable to reduce the S content as much as possible. If the S content is more than 0.040%, the influence of S is significant. The S content is therefore preferably 0.040% or less. The S content is more preferably 0.020% or less, and further preferably 0.015% or less. Although no lower limit is placed on the S content, excessive desulfurization leads to higher production costs. The S content is therefore preferably 0.0001% or more.

Ni: 0.01% to 2.50%

Ni is an element that contributes to improved toughness of the steel sheet, suppresses fractures of the steel sheet during the production process, and improves the productivity of the steel sheet. To achieve this effect, the Ni content is preferably 0.01% or more. If the Ni content is more than 2.50%, descaling in the production process may be difficult, causing a decrease in the productivity of the steel sheet. The Ni content is therefore preferably in the range of 0.01% to 2.50%. The Ni content is more preferably 0.05% or more. The Ni content is more preferably less than 1.00%, and further preferably less than 0.30%.

Cr: 10.5% to 32.0%

Cr is an element that contributes to improved corrosion resistance of the steel sheet. To achieve this effect, the Cr content is preferably 10.5% or more. If the Cr content is more than 32.0%, surface roughening is likely to occur during hot rolling, causing a decrease in the productivity of the steel sheet. The Cr content is therefore preferably in the range of 10.5% to 32.0%. The Cr content is more preferably 12.0% or more, and further preferably 16.0% or more. The Cr content is more preferably 22.0% or less, and further preferably 18.0% or less.

Al: 0.001% to 6.5%

Al is an element that acts as a deoxidizer to reduce inclusions in the steel that cause surface defects in the steel sheet and enhance the productivity of the steel sheet, as with Si. To achieve this effect, the Al content is preferably 0.001% or more. If the Al content is more than 6.5%, the steel embrittles and tends to crack, causing a decrease in the productivity of the steel sheet. The Al content is therefore preferably in the range of 0.001% to 6.5%. The Al content is more preferably 0.600% or less, and further preferably 0.060% or less.

N: 0.001% to 0.100%

N has the effect of, as a result of dissolving in the steel, increasing the strength of the steel sheet to suppress scratches during production and enhance the productivity of the steel sheet, as with C. If the N content is less than 0.001%, the effect is insufficient. If the N content is more than 0.100%, defects are likely to occur on the surface of the steel sheet. Such defects may determine the degree of surface roughness of the steel sheet, making the surface roughness of the steel sheet noticeable. The N content is therefore preferably in the range of 0.001% to 0.100%. The N content is more preferably 0.005% or more, and further preferably 0.010% or more. The N content is more preferably 0.080% or less, and further preferably 0.050% or less.

While the basic components of the first chemical composition have been described above, the first chemical composition may optionally further contain one or more elements from among the foregoing (group A) to (group C).

Cu: 2.00% or Less

Cu has the effect of enhancing the strength of the steel sheet. To achieve this effect, the Cu content is preferably 0.01% or more. The Cu content is more preferably 0.05% or more, and further preferably 0.10% or more. If the Cu content is more than 2.00%, a large amount of ε-Cu phase is contained in the steel, which serves as a corrosion initiation point and causes a decrease in the corrosion resistance of the steel sheet. Accordingly, in the case where Cu is contained, the Cu content is preferably 2.00% or less. The Cu content is more preferably 0.50% or less, and further preferably 0.20% or less.

Co: 2.00% or Less

Co has the effect of enhancing the strength of the steel sheet. To achieve this effect, the Co content is preferably 0.01% or more. The Co content is more preferably 0.05% or more, and further preferably 0.10% or more. If the Co content is more than 2.00%, the steel sheet embrittles. Accordingly, in the case where Co is contained, the Co content is preferably 2.00% or less. The Co content is more preferably 0.50% or less, and further preferably 0.20% or less.

Mo: 3.00% or Less

Mo is an element that improves the corrosion resistance of the steel sheet. To achieve this effect, the Mo content is preferably 0.01% or more. The Mo content is more preferably 0.05% or more, further preferably 0.10% or more, and even more preferably 0.15% or more. If the Mo content is more than 3.00%, the steel sheet embrittles. Accordingly, in the case where Mo is contained, the Mo content is preferably 3.00% or less. The Mo content is more preferably 0.80% or less, further preferably 0.60% or less, and even more preferably 0.45% or less.

W: 2.00% or Less

W is an element that improves the corrosion resistance of the steel sheet. To achieve this effect, the W content is preferably 0.01% or more. The W content is more preferably 0.05% or more, and further preferably 0.10% or more. If the W content is more than 2.00%, the steel sheet embrittles. Accordingly, in the case where W is contained, the W content is preferably 2.00% or less. The W content is more preferably 0.50% or less, and further preferably 0.20% or less.

Ti: 0.50% or Less

Ti is an element that improves the corrosion resistance of the steel sheet. To achieve this effect, the Ti content is preferably 0.01% or more. The Ti content is more preferably 0.02% or more, and further preferably 0.03% or more. If the Ti content is more than 0.50%, the steel sheet embrittles. Accordingly, in the case where Ti is contained, the Ti content is preferably 0.50% or less. The Ti content is more preferably 0.30% or less, and further preferably 0.10% or less.

Nb: 1.00% or Less

Nb has the effect of improving the corrosion resistance of the steel sheet, as with Ti. To achieve this effect, the Nb content is preferably 0.01% or more. The Nb content is more preferably 0.02% or more, and further preferably 0.03% or more. If the Nb content is more than 1.00%, the steel sheet embrittles. Accordingly, in the case where Nb is contained, the Nb content is preferably 1.00% or less. The Nb content is more preferably 0.50% or less, and further preferably 0.20% or less.

V: 0.50% or Less

V has the effect of improving the corrosion resistance of the steel sheet, as with Ti and Nb. To achieve this effect, the V content is preferably 0.01% or more. The V content is more preferably 0.02% or more, and further preferably 0.03% or more. If the V content is more than 0.50%, the steel sheet embrittles. Accordingly, in the case where Vis contained, the V content is preferably 0.50% or less. The V content is more preferably 0.20% or less, and further preferably 0.10% or less.

Zr: 0.50% or Less

Zr has the effect of improving the corrosion resistance of the steel sheet, as with Ti and Nb. To achieve this effect, the Zr content is preferably 0.01% or more. The Zr content is more preferably 0.02% or more, and further preferably 0.03% or more. If the Zr content is more than 0.50%, the steel sheet embrittles. Accordingly, in the case where Zr is contained, the Zr content is preferably 0.50% or less. The Zr content is more preferably 0.20% or less, and further preferably 0.10% or less.

B: 0.0050% or Less

B is an element that prevents edge cracking of the steel sheet during hot rolling and improves the productivity of the steel sheet. To achieve this effect, the B content is preferably 0.0002% or more. The B content is more preferably 0.0003% or more, and further preferably 0.0005% or more. If the B content is more than 0.0050%, hot workability decreases, causing a decrease in the productivity of the steel sheet. Accordingly, in the case where B is contained, the B content is preferably 0.0050% or less. The B content is more preferably 0.0030% or less, and further preferably 0.0020% or less.

Mg: 0.0050% or Less

Mg forms Mg oxide with Al in molten steel and acts as a deoxidizer. To achieve this effect, the Mg content is preferably 0.0005% or more. The Mg content is more preferably 0.0010% or more. If the Mg content is more than 0.0050%, the steel sheet embrittles. Accordingly, in the case where Mg is contained, the Mg content is preferably 0.0050% or less. The Mg content is more preferably 0.0030% or less.

Ca: 0.0030% or Less

Ca forms oxides in molten steel and acts as a deoxidizer. To achieve this effect, the Ca content is preferably 0.0003% or more. The Ca content is more preferably 0.0005% or more, and further preferably 0.0007% or more. If the Ca content is more than 0.0030%, a large amount of CaS forms in the steel, which serves as a corrosion initiation point and causes a decrease in the corrosion resistance of the steel sheet. Accordingly, in the case where Ca is contained, the Ca content is preferably 0.0030% or less. The Ca content is more preferably 0.0025% or less, and further preferably 0.0015% or less.

Y: 0.20% or Less

Y is an element that prevents edge cracking of the steel sheet during hot rolling and improves the productivity of the steel sheet. To achieve this effect, the Y content is preferably 0.01% or more. The Y content is more preferably 0.02% or more. If the Y content is more than 0.20%, hot workability decreases, causing a decrease in the productivity of the steel sheet. Accordingly, in the case where Y is contained, the Y content is preferably 0.20% or less. The Y content is more preferably 0.05% or less.

REM: 0.20% or Less

REM (rare earth metal) is an element that prevents edge cracking of the steel sheet during hot rolling and improves the productivity of the steel sheet. To achieve this effect, the REM content is preferably 0.01% or more. The REM content is more preferably 0.02% or more. If the REM content is more than 0.20%, hot workability decreases, causing a decrease in the productivity of the steel sheet. Accordingly, in the case where REM is contained, the REM content is preferably 0.20% or less. The REM content is more preferably 0.05% or less. REM refers to any element belonging to Group 3 of the periodic table (excluding Y).

Sn: 0.50% or Less

Sn is an element that prevents surface roughening of the steel sheet during hot rolling and improves the productivity of the steel sheet. To achieve this effect, the Sn content is preferably 0.01% or more. The Sn content is more preferably 0.03% or more. If the Sn content is more than 0.50%, the steel sheet embrittles. Accordingly, in the case where Sn is contained, the Sn content is preferably 0.50% or less. The Sn content is more preferably 0.20% or less.

Sb: 0.50% or Less

Sb is an element that prevents surface roughening of the steel sheet during hot rolling and improves the productivity of the steel sheet. To achieve this effect, the Sb content is preferably 0.01% or more. The Sb content is more preferably 0.03% or more. If the Sb content is more than 0.50%, the steel sheet embrittles. Accordingly, in the case where Sb is contained, the Sb content is preferably 0.50% or less. The Sb content is more preferably 0.20% or less.

The balance other than the above-described components consists of Fe and inevitable impurities.

Second Chemical Composition

The second chemical composition contains, in mass %, C: 0.001% to 0.150%, Si: 0.01% to 1.00%, Mn: 0.01% to 1.00%, P: 0.050% or less, S: 0.040% or less, Ni: 0.01% to 0.80%, Cr: 10.5% to 20.0%, Al: 0.001% to 0.500%, and N: 0.001% to 0.100%, and optionally one or more groups selected from the following (group A') to (group C'), with the balance consisting of Fe and inevitable impurities.

(group A'): one or more selected from Cu: 0.50% or less, Co: 0.50% or less, Mo: 0.50% or less, and W: 2.00% or less.

(group B'): one or more selected from Ti: 0.05% or less, Nb: 0.05% or less, V: 0.10% or less, and Zr: 0.05% or less.

(group C'): one or more selected from B: 0.0050% or less, Mg: 0.0050% or less, Ca: 0.0030% or less, Y: 0.20% or less, REM (rare earth metal): 0.20% or less, Sn: 0.50% or less, and Sb: 0.50% or less.

The second chemical composition will be described below. The second chemical composition is particularly suitable for use in the production method by the below-described mixed acid pickling single method. Of the basic components, the elements other than Si, Mn, Ni, Cr, and Al are the same as those in the first chemical composition and accordingly their description is omitted here.

Si: 0.01% to 1.00%

Si is an element that acts as a deoxidizer during steelmaking to reduce inclusions in the steel that cause surface defects in the steel sheet and enhance the productivity of the steel sheet. Si also has the effect of increasing the strength of the steel sheet to suppress scratches during production and enhance the productivity of the steel sheet. To achieve these effects, the Si content is preferably 0.01% or more. If the Si content is more than 1.00%, the formation of fine irregularities on the surface of the steel sheet by mixed acid pickling is hindered, and whiteness decreases. The Si content is therefore preferably in the range of 0.01% to 1.00%. The Si content is more preferably 0.10% or more, and further preferably 0.20% or more. The Si content is more preferably 0.60% or less, and further preferably 0.30% or less.

Mn: 0.01% to 1.00%

Mn has the effect of increasing the strength of the steel sheet to suppress scratches during production and enhance the productivity of the steel sheet. To achieve this effect, the Mn content is preferably 0.01% or more. If the Mn content is more than 1.00%, MnS is likely to form in the steel, which may serve as a corrosion initiation point and cause a decrease in the corrosion resistance of the steel sheet. The Mn content is therefore preferably in the range of 0.01% to 1.00%. The Mn content is more preferably 0.20% or more, and further preferably 0.30% or more. The Mn content is more preferably 0.85% or less, and further preferably 0.70% or less.

Ni: 0.01% to 0.80%

Ni is an element that contributes to improved toughness of the steel sheet, suppresses fractures of the steel sheet during the production process, and improves the productivity of the steel sheet. To achieve this effect, the Ni content is preferably 0.01% or more. If the Ni content is more than 0.80%, the formation of fine irregularities on the surface of the steel sheet by mixed acid pickling is hindered, and whiteness decreases. The Ni content is therefore preferably in the range of 0.01% to 0.80%. The Ni content is more preferably 0.05% or more. The Ni content is more preferably 0.60% or less, and further preferably 0.30% or less.

Cr: 10.5% to 20.0%

Cr is an element that contributes to improved corrosion resistance of the steel sheet. If the Cr content is less than 10.5%, sufficient corrosion resistance cannot be obtained. If the Cr content is more than 20.0%, the formation of fine irregularities on the surface of the steel sheet by mixed acid pickling is hindered, and whiteness decreases. The Cr content is therefore preferably in the range of 10.5% to 20.0%. The Cr content is more preferably 11.0% or more, further preferably 13.0% or more, and even more preferably 16.0% or more. The Cr content is more preferably 18.0% or less, and further preferably 16.5% or less.

Al: 0.001% to 0.500%

Al is an element that acts as a deoxidizer to reduce inclusions in the steel that cause surface defects in the steel sheet and enhance the productivity of the steel sheet, as with Si. To achieve this effect, the Al content is preferably 0.001% or more. If the Al content is more than 0.500%, the formation of AlN and $Al_2O_3$ increases and minute defects are likely to occur on the surface of the steel sheet. Such defects are noticeable as a factor of surface roughness particularly on a fine sheet surface, and cause an increase in the degree of surface roughness of the sheet surface. The Al content is therefore preferably in the range of 0.001% to 0.500%. The Al content is more preferably 0.100% or less, and further preferably 0.010% or less.

While the basic components of the second chemical composition have been described above, the second chemical composition may optionally further contain one or more elements from among the foregoing (group A') to (group C'). Of such optionally added components, the elements other than Cu, Co, Mo, Ti, Nb, V, and Zr are the same as those in the first chemical composition and accordingly their description is omitted here.

Cu: 0.50% or Less

Cu has the effect of enhancing the strength of the steel sheet. To achieve this effect, the Cu content is preferably 0.01% or more. The Cu content is more preferably 0.05% or more, and further preferably 0.10% or more. If the Cu content is more than 0.50%, a large amount of E-Cu phase is contained in the steel, which serves as a corrosion initiation point and causes a decrease in the corrosion resistance of the steel sheet. Accordingly, in the case where Cu is contained, the Cu content is preferably 0.50% or less. The Cu content is more preferably 0.30% or less, and further preferably 0.15% or less.

Co: 0.50% or Less

Co has the effect of enhancing the strength of the steel sheet. To achieve this effect, the Co content is preferably 0.01% or more. The Co content is more preferably 0.05% or more, and further preferably 0.10% or more. If the Co content is more than 0.50%, the steel sheet embrittles. Accordingly, in the case where Co is contained, the Co content is preferably 0.50% or less. The Co content is more preferably 0.30% or less, and further preferably 0.15% or less.

Mo: 0.50% or Less

Mo is an element that improves the corrosion resistance of the steel sheet. To achieve this effect, the Mo content is preferably 0.01% or more. The Mo content is more preferably 0.05% or more, and further preferably 0.10% or more. If the Mo content is more than 0.50%, the formation of fine irregularities on the surface of the steel sheet by mixed acid pickling is hindered, and whiteness decreases. Accordingly, in the case where Mo is contained, the Mo content is preferably 0.50% or less. The Mo content is more preferably 0.30% or less, and further preferably 0.15% or less.

Ti: 0.05% or Less

Ti is an element that improves the corrosion resistance of the steel sheet. To achieve this effect, the Ti content is preferably 0.01% or more. If the Ti content is more than 0.05%, minute defects are likely to occur on the surface of the steel sheet. Such defects are noticeable as a factor of surface roughness particularly on a fine sheet surface, and cause an increase in the degree of surface roughness of the sheet surface. Accordingly, in the case where Ti is contained, the Ti content is 0.05% or less.

Nb: 0.05% or Less

Nb has the effect of improving the corrosion resistance of the steel sheet, as with Ti. To achieve this effect, the Nb content is preferably 0.01% or more. If the Nb content is more than 0.05%, minute defects are likely to occur on the surface of the steel sheet. Such defects are noticeable as a factor of surface roughness particularly on a fine sheet surface, and cause an increase in the degree of surface roughness of the sheet surface. Accordingly, in the case where Nb is contained, the Nb content is 0.05% or less.

V: 0.10% or Less

V has the effect of improving the corrosion resistance of the steel sheet, as with Ti and Nb. To achieve this effect, the V content is preferably 0.01% or more. If the V content is more than 0.10%, minute defects are likely to occur on the surface of the steel sheet. Such defects are noticeable as a factor of surface roughness particularly on a fine sheet surface, and cause an increase in the degree of surface roughness of the sheet surface. Accordingly, in the case where Vis contained, the V content is 0.10% or less.

Zr: 0.05% or Less

Zr has the effect of improving the corrosion resistance of the steel sheet, as with Ti and Nb. To achieve this effect, the Zr content is preferably 0.01% or more. If the Zr content is more than 0.05%, minute defects are likely to occur on the surface of the steel sheet. Such defects are noticeable as a factor of surface roughness particularly on a fine sheet surface, and cause an increase in the degree of surface roughness of the sheet surface. Accordingly, in the case where Zr is contained, the Zr content is 0.05% or less.

The balance other than the above-described components consists of Fe and inevitable impurities.

[3] Production Method for Ferritic Stainless Steel Sheet

A production method for a ferritic stainless steel sheet according to an embodiment of the present disclosure will be described below. Hereafter, the dull rolling nitrohydrochloric acid electrolysis method is also referred to as Embodiment 1, the dull rolling mixed acid immersion method as Embodiment 2, and the mixed acid pickling single method as Embodiment 3.

A production method according to each of Embodiments 1 and 2 comprises: preparing a material for cold rolling; thereafter cold rolling the material for cold rolling to obtain a cold-rolled steel sheet; thereafter annealing the cold-rolled steel sheet to obtain a cold-rolled and annealed steel sheet; thereafter pickling the cold-rolled and annealed steel sheet; and thereafter skin pass rolling the cold-rolled and annealed steel sheet.

A production method according to Embodiment 3 comprises: preparing a blank steel sheet; thereafter annealing the blank steel sheet to obtain an annealed steel sheet; thereafter pickling the annealed steel sheet; and thereafter skin pass rolling the annealed steel sheet.

In the cold rolling, the pickling, and/or the skin pass rolling, the following three types of surface irregularities with different periods are imparted to the sheet surface in order to obtain certain surface texture. Of the following three types of surface irregularities, A-type surface irregularities and B-type surface irregularities mainly correspond to the foregoing valley-plateau irregularities, and C-type surface irregularities correspond to the foregoing fine irregularities.

- A-type surface irregularities are surface irregularities mainly having an irregularity period of 100 μm to 1000 μm, and are imparted to the sheet surface by, for example, cold rolling using a dull roll.
- B-type surface irregularities are surface irregularities mainly having an irregularity period of 10 μm to 100 μm, and are imparted to the sheet surface by, for example, pickling through immersion treatment in the mixed acid.
- C-type surface irregularities are surface irregularities mainly having an irregularity period of 10 μm or less, and are imparted to the sheet surface by, for example, pickling through immersion treatment in the mixed acid or positive electrolytic treatment in the nitrohydrochloric acid aqueous solution.

More specifically, the dull rolling nitrohydrochloric acid electrolysis method of Embodiment 1 mainly imparts the A-type surface irregularities to the sheet surface by cold rolling and imparts the C-type surface irregularities to the sheet surface by pickling through positive electrolytic treatment in the nitrohydrochloric acid aqueous solution. As mentioned above, the surface roughness resistance is significantly influenced by the longest period of location-by-location fluctuation in light reflection characteristics, i.e. the longest period of surface irregularities. That is, the surface irregularities with the longest period are the governing factor for the surface roughness resistance of the sheet surface (the surface roughness of the sheet surface is more noticeable when the longest period of surface irregularities is longer, and the surface roughness of the sheet surface is less noticeable and the sheet surface appears more even (i.e. finer) when the longest period of surface irregularities is shorter). Hence, in the steel sheet produced by the dull rolling nitrohydrochloric acid electrolysis method of Embodiment 1, the A-type surface irregularities are the governing factor for the surface roughness resistance of the sheet surface.

The dull rolling mixed acid immersion method of Embodiment 2 mainly imparts the A-type surface irregularities to the sheet surface by cold rolling and imparts the B-type surface irregularities and the C-type surface irregularities to the sheet surface by pickling through immersion treatment in the mixed acid. Here, since the B-type surface irregularities imparted to the sheet surface in the dull rolling mixed acid immersion method are shorter in period than the A-type surface irregularities, the B-type surface irregularities are mostly hidden behind the A-type surface irregularities and are not noticeable. Hence, the B-type surface irregularities imparted to the sheet surface in the dull rolling mixed acid immersion method are not the governing factor for the surface roughness resistance of the sheet surface but the A-type surface irregularities are the governing factor for the surface roughness resistance of the sheet surface. In this respect, the influence of the B-type surface irregularities imparted to the sheet surface in the dull rolling mixed acid immersion method on the surface roughness resistance is different from the influence of the B-type surface irregularities imparted to the sheet surface in the below-described mixed acid pickling single method of Embodiment 3 on the surface roughness resistance.

The mixed acid pickling single method of Embodiment 3 mainly imparts the B-type surface irregularities and the C-type surface irregularities to the sheet surface by pickling through immersion treatment in the mixed acid. The B-type surface irregularities are shorter in period than the A-type surface irregularities. It is therefore possible to produce a stainless steel sheet having better surface roughness resistance than the dull rolling nitrohydrochloric acid electrolysis method of Embodiment 1 and the dull rolling mixed acid immersion method of Embodiment 2.

First, the dull rolling nitrohydrochloric acid electrolysis method of Embodiment 1 will be described below. The dull rolling nitrohydrochloric acid electrolysis method of Embodiment 1 and the dull rolling mixed acid immersion method of Embodiment 2 include substantially the same steps except for the pickling step. Accordingly, these two embodiments are hereafter also collectively referred to as "dull rolling method".

Embodiment 1: Dull Rolling Nitrohydrochloric Acid Electrolysis Method

Preparation

First, a material for cold rolling is prepared. Examples of the material for cold rolling include a hot-rolled steel sheet and a hot-rolled and annealed steel sheet. The method of preparing the material for cold rolling is not limited. In one aspect, for example, molten steel adjusted to satisfy the range of a predetermined chemical composition, preferably the first chemical composition, is obtained by steelmaking in a melting furnace such as a converter, an electric furnace, or a vacuum melting furnace. The molten steel is then made into a steel material (steel slab) by continuous casting, ingot casting and blooming, or the like. The steel material is then subjected to hot rolling to obtain a hot-rolled steel sheet. The hot-rolled steel sheet is then subjected to hot-rolled sheet annealing to obtain a hot-rolled and annealed steel sheet. The obtained hot-rolled and annealed steel sheet is optionally subjected to descaling treatment by pickling, shot blasting, surface grinding, etc., to obtain a material for cold rolling. The hot-rolled and annealed steel sheet may be optionally subjected to skin pass rolling.

The conditions for the foregoing hot rolling and hot-rolled sheet annealing are not limited, and may be in accordance with conventional methods. For example, for hot rolling, the steel material is heated to 1050° C. to 1250° C. and held in the temperature range for 30 minutes to 24 hours, and then rolled. Alternatively, if the steel material is in the temperature range as it is immediately after casting, the steel material is rolled without heating. The hot rolling ratio is not limited, and may be adjusted as appropriate depending on, for example, the required thickness of the finished product.

An example of the conditions for hot-rolled sheet annealing is heating the hot-rolled steel sheet to the temperature range of 750° C. to 850° C. and holding the hot-rolled steel sheet in the temperature range for 1 hour to 24 hours. Another example of the conditions for hot-rolled sheet annealing is heating the hot-rolled steel sheet to the temperature range of 900° C. to 1100° C. and holding the hot-rolled steel sheet in the temperature range for 1 second to 10 minutes.

(Cold Rolling)

The material for cold rolling prepared as described above is subjected to cold rolling to obtain a cold-rolled steel sheet. It is important that the dull roll used in the final pass is a dull roll having predetermined surface irregularities, specifically, a dull roll with Ra: 1.00 μm or more, Sal: 50.0 μm or less, and Str: 0.30 or more, and the rolling reduction ratio in the final pass is 0.80% or more. This makes it possible to form irregularities serving as valley portions and plateau portions on the steel sheet surface and ensure a predetermined area ratio of the valley portions.

Ra of Dull Roll Used in Final Pass: 1.00 μm or More

If Ra of the dull roll used in the final pass (hereafter also referred to as "final pass roll") is less than 1.00 μm, the height of the irregularities of the roll surface is low, so that the height of the dull irregularities transferred to the cold-rolled steel sheet is low. In this case, even if the subsequent steps are carried out under appropriate conditions, the dull irregularities are likely to disappear due to the below-described skin pass rolling, and the area ratio of the valley portions on the steel sheet surface after the skin pass rolling is insufficient. As a result, the desired whiteness cannot be obtained. Accordingly, Ra of the final pass roll is 1.00 μm or more. Ra of the final pass roll is preferably 2.00 μm or more. Although no upper limit is placed on Ra of the final pass roll, Ra of the final pass roll is preferably 3.00 μm or less. Ra is measured in accordance with JIS B 0601: 2013. Ra is measured in a direction perpendicular to the circumferential direction of the roll surface.

Sal of Final Pass Roll: 50.0 μm or Less

If Sal of the final pass roll is more than 50.0 μm, the period of the irregularities of the roll surface is long, so that the period of the dull irregularities transferred to the cold-rolled steel sheet is long. In this case, even if the subsequent steps are carried out under appropriate conditions, the dull irregularities with a long period are maintained in the surface of the steel sheet as a finished product, and the surface roughness is noticeable. As a result, the desired surface roughness resistance cannot be obtained. Accordingly, Sal of the final pass roll is 50.0 μm or less. Sal of the final pass roll is preferably 35.0 μm or less. Although no lower limit is placed on Sal of the final pass roll, Sal of the final pass roll is preferably 25.0 μm or more.

Str of Final Pass Roll: 0.30 or More

If Str of the final pass roll is less than 0.30, even when Sal is set to 50.0 μm or less, the period of the irregularities of the roll surface is long depending on the in-plane direction. Hence, the period of the dull irregularities transferred to the cold-rolled steel sheet is long depending on the in-plane direction. In this case, even if the subsequent steps are carried out under appropriate conditions, the dull irregularities with a long period are maintained in the surface of the steel sheet as a finished product, and the surface roughness is noticeable. As a result, the desired surface roughness resistance cannot be obtained. Accordingly, Str of the final pass roll is 0.30 or more. Str of the final pass roll is preferably 0.70 or more. Although no upper limit is placed on Str of the final pass roll, Str of the final pass roll is preferably 0.90 or less.

Sal and Str of the final pass roll are calculated by the foregoing method using a replica collected from the roll surface. In the case where the surface shape of the replica contains curved surface components due to the roll shape or waviness components generated when collecting the replica, in order to exclude the influence of these components on each surface texture parameter, F operation or L filter is applied to the shape data to remove the curved surface components due to the roll shape and the waviness components due to the replica before the calculation of each surface texture parameter.

Rolling Reduction Ratio in Final Pass: 0.80% or More

If the rolling reduction ratio in the final pass is less than 0.80%, the transfer of dull irregularities to the cold-rolled steel sheet is insufficient, and the height of the dull irregularities formed on the surface of the cold-rolled steel sheet is low. In this case, even if the subsequent steps are carried out under appropriate conditions, the dull irregularities are likely to disappear due to the below-described skin pass rolling, and the area ratio of the valley portions on the steel sheet surface after the skin pass rolling is insufficient. As a result, the desired whiteness cannot be obtained. Accordingly, the rolling reduction ratio in the final pass is 0.80% or more. The rolling reduction ratio in the final pass is preferably 0.90% or more. Although no upper limit is placed on the rolling reduction ratio in the final pass, the rolling reduction ratio in the final pass is preferably 1.50% or less.

Conditions other than the above are not limited and may be in accordance with conventional methods. For example, the total rolling reduction ratio in cold rolling and the rolling reduction ratio in each rolling pass other than the final pass may be set as appropriate depending on the target sheet thickness of the stainless steel sheet as a finished product. The number of rolling passes is not limited, but is preferably 4 to 6 passes, for example.

The final pass roll can be prepared, for example, by subjecting the roll surface to shot blasting treatment or liquid honing treatment. If the treatment time of such treatment is insufficient, part of the roll surface texture before the treatment remains on the roll surface after the treatment, and Str decreases. If the abrasive grains projected onto the roll are large, Sal increases. If the projection speed of the abrasive grains to the roll is low, Ra decreases. By adjusting the grain size of the abrasive grains projected onto the roll and the projection speed of the abrasive grains and performing the treatment over a sufficient period of time, it is possible to form the desired surface texture on the roll.

(Cold-Rolled Sheet Annealing)

Next, the cold-rolled steel sheet is annealed to obtain a cold-rolled and annealed steel sheet. The cold-rolled sheet annealing conditions are not limited. In one aspect, for example, using a batch annealing furnace or a continuous annealing furnace, the cold-rolled steel sheet is held at 800° C. or more and 1050° C. or less for 5 seconds or more and 10 hours or less in an oxidizing atmosphere such as air or a non-oxidizing atmosphere such as nitrogen or ammonia decomposition gas. From the viewpoint of productivity, it is preferable to hold the cold-rolled steel sheet for 3 minutes or less in a non-oxidizing atmosphere using a continuous annealing furnace.

(Pickling)

Next, the cold-rolled and annealed steel sheet is pickled. In the pickling, positive electrolytic treatment is performed under the following treatment conditions:

treatment solution: a nitrohydrochloric acid aqueous solution having a hydrochloric acid concentration of 0.10 mass % to 5.00 mass % and a nitric acid concentration of 10.0 mass % to 20.0 mass %, treatment temperature: 30° C. to 65° C., treatment time: 1.0 second to 60.0 seconds, and current density: 5.0 A/dm$^2$ to 20.0 A/dm$^2$.

Through this treatment, fine irregularities are formed on the surface of the steel sheet to roughen the valley portions.

Hydrochloric Acid Concentration of Treatment Solution: 0.10 Mass % to 5.00 Mass %

If the hydrochloric acid concentration of the treatment solution is less than 0.10 mass %, the formation of fine irregularities on the steel sheet surface is insufficient and the valley portions are not roughened sufficiently, as a result of which the desired whiteness cannot be obtained. If the hydrochloric acid concentration of the treatment solution is more than 5.00 mass %, the formation of fine irregularities on the steel sheet surface is excessive and, even when the subsequent skin pass rolling is appropriately performed, the fine irregularities remain in the plateau portions. As a result, the desired image clarity cannot be obtained. The hydrochloric acid concentration of the treatment solution is therefore 0.10 mass % to 5.00 mass %. The hydrochloric acid concentration of the treatment solution is preferably 0.40 mass % or more. The hydrochloric acid concentration of the treatment solution is preferably 1.00 mass % or less.

Nitric Acid Concentration of Treatment Solution: 10.0 Mass % to 20.0 Mass %

If the nitric acid concentration of the treatment solution is less than 10.0 mass %, the formation of fine irregularities on the steel sheet surface is insufficient and the valley portions are not roughened sufficiently, as a result of which the desired whiteness cannot be obtained. If the nitric acid concentration of the treatment solution is more than 20.0 mass %, the formation of fine irregularities on the steel sheet surface is excessive and, even when the subsequent skin pass rolling is appropriately performed, the fine irregularities remain in the plateau portions. As a result, the desired image clarity cannot be obtained. The nitric acid concentration of the treatment solution is therefore 10.0 mass % to 20.0 mass %.

As long as the aqueous solution (nitrohydrochloric acid aqueous solution) as the treatment solution has the foregoing hydrochloric acid concentration and nitric acid concentration, the aqueous solution may contain inevitable impurities such as Fe ions and Cr ions, which are common in pickling treatment solutions.

Treatment Temperature (Temperature of Treatment Solution): 30° C. to 65° C.

If the treatment temperature is less than 30° C., the formation of fine irregularities on the steel sheet surface is insufficient and the valley portions are not roughened sufficiently, as a result of which the desired whiteness cannot be obtained. If the treatment temperature is more than 65° C., the formation of fine irregularities on the steel sheet surface is excessive and, even when the subsequent skin pass rolling is appropriately performed, the fine irregularities remain in the plateau portions. As a result, the desired image clarity cannot be obtained. The treatment temperature is therefore 30° C. to 65° C.

Treatment Time (Electrolysis Time in Treatment Solution): 1.0 Second to 60.0 Seconds If the treatment time is less than 1.0 second, the formation of fine irregularities on the steel sheet surface is insufficient and the valley portions are not roughened sufficiently, as a result of which the desired whiteness cannot be obtained. If the treatment time is more than 60.0 seconds, the formation of fine irregularities on the steel sheet surface is excessive and, even when the subsequent skin pass rolling is appropriately performed, the fine irregularities remain in the plateau portions. As a result, the desired image clarity cannot be obtained. The treatment time is therefore 1.0 second to 60.0 seconds.

Current Density: 5.0 A/dm$^2$ to 20.0 A/dm$^2$

If the current density in the positive electrolytic treatment is less than 5.0 A/dm$^2$, the formation of fine irregularities on the steel sheet surface is insufficient and the valley portions are not roughened sufficiently, as a result of which the desired whiteness cannot be obtained. If the current density in the positive electrolytic treatment is more than 20.0 A/dm$^2$, the formation of fine irregularities on the steel sheet surface is excessive and, even when the subsequent skin pass rolling is appropriately performed, the fine irregularities remain in the plateau portions. As a result, the desired image clarity cannot be obtained. The current density in the positive electrolytic treatment is therefore 5.0 A/dm$^2$ to 20.0 A/dm$^2$.

The positive electrolytic treatment may be performed in a plurality of steps. In the case where the treatment is divided into a plurality of steps, the hydrochloric acid concentration and nitric acid concentration of the treatment solution, the treatment temperature, and the current density in the treatment in each step are within the foregoing ranges, and the sum of the treatment times in the plurality of steps is within the foregoing range (1.0 second to 60.0 seconds).

In a typical production line structure, reverse electrolytic treatment is performed on the steel sheet before or after positive electrolytic treatment. Here, reverse electrolytic treatment may be performed. The electrolytic current density, etc. in the reverse electrolytic treatment are not limited. The foregoing treatment time does not include the treatment time of such reverse electrolytic treatment.

Another pickling treatment may be performed before or after the foregoing pickling by the positive electrolytic treatment. For example, in the case where cold-rolled sheet annealing is performed in an oxidizing atmosphere, electrolytic treatment using a sodium sulfate aqueous solution may be performed for the purpose of scale removal before the foregoing pickling by the positive electrolytic treatment. Immersion treatment in a nitric acid aqueous solution and electrolytic treatment using a nitric acid aqueous solution may be performed for the purpose of passivation treatment after the foregoing pickling by the positive electrolytic treatment.

(Skin Pass Rolling)

Next, the pickled cold-rolled and annealed steel sheet is subjected to skin pass rolling. It is important that the dull roll used in the skin pass rolling (hereafter also referred to as "skin pass roll") is a dull roll having Ra of 0.30 μm or less and the elongation ratio is 0.10% to 3.00%. In this way, the convex portions of the irregularities formed by cold rolling are leveled to form plateau portions, and simultaneously the fine irregularities of the plateau portions are flattened to thus enhance image clarity.

Ra of Skin Pass Roll: 0.30 μm or Less

If Ra of the skin pass roll is more than 0.30 μm, the plateau portions roughened in the pickling cannot be flattened sufficiently, as a result of which the desired image clarity cannot be obtained. Ra of the skin pass roll is therefore 0.30 μm or less. No lower limit is placed on Ra of the skin pass roll. However, if Ra is excessively low, the rolling load increases. Moreover, rolling defects are likely to occur on the steel sheet surface, resulting in a decrease in productivity. Ra of the skin pass roll is therefore preferably 0.10 μm or more. Ra is measured in accordance with JIS B 0601: 2013. Ra is measured in a direction perpendicular to the circumferential direction of the roll surface.

Elongation Ratio: 0.10% to 3.00%

If the elongation ratio of skin pass rolling is less than 0.10%, the area ratio of the plateau portions on the steel sheet surface is insufficient. As a result, the desired image clarity cannot be obtained. If the elongation ratio of skin pass rolling is more than 3.00%, the area ratio of the valley portions on the steel sheet surface is insufficient. As a result, the desired whiteness cannot be obtained. The elongation ratio is therefore 0.10% to 3.00%. The elongation ratio is preferably 1.50% or less.

Skin pass rolling may be performed in one pass or in a plurality of passes. In the case where skin pass rolling is performed in a plurality of passes, the total elongation ratio of the plurality of passes is within the foregoing range (0.10% to 3.00%). The elongation ratio of skin pass rolling (skin pass elongation ratio) (%) is calculated by the following formula:

$$\text{Elongation ratio}(\%) = (\text{length of stainless steel sheet after skin pass rolling})/(\text{length of stainless steel sheet before skin pass rolling}) \times 100 - 100.$$

The roll diameter of the skin pass roll and the steel sheet speed during rolling are not limited. For example, the roll diameter of the skin pass roll is 400 mm to 500 mm, and the steel sheet speed is 50 mpm to 200 mpm. Tension may be applied to the steel sheet during skin pass rolling. The tension is not limited, but is preferably 3 kgf/mm$^2$ or more and 6 kgf/mm$^2$ or less, for example.

Conditions other than the above are not limited and may be in accordance with conventional methods.

Embodiment 2: Dull Rolling Mixed Acid Immersion Method

Next, the dull rolling mixed acid immersion method of Embodiment 2 will be described below. As mentioned above, the dull rolling nitrohydrochloric acid electrolysis method of Embodiment 1 and the dull rolling mixed acid immersion method of Embodiment 2 include substantially the same steps except for the pickling step. Accordingly, only the pickling step will be described here while omitting the description of the other steps.

(Pickling)

In the pickling in Embodiment 2, immersion treatment is performed under the following treatment conditions:

- treatment solution: a mixed acid aqueous solution having a hydrofluoric acid concentration of 1.0 mass % to 8.0 mass % and a nitric acid concentration of 2.0 mass % to 12.0 mass %,
- treatment temperature: 30° C. to 65° C., and
- treatment time: 25 seconds to 600 seconds.

Through this treatment, fine irregularities are formed on the surface of the steel sheet to roughen the valley portions.

Hydrofluoric Acid Concentration of Treatment Solution: 1.0 Mass % to 8.0 Mass %

If the hydrofluoric acid concentration of the treatment solution is less than 1.0 mass %, the formation of fine irregularities on the steel sheet surface is insufficient and the valley portions are not roughened sufficiently, as a result of which the desired whiteness cannot be obtained. If the hydrofluoric acid concentration of the treatment solution is more than 8.0 mass %, the formation of fine irregularities on the steel sheet surface is excessive and, even when the subsequent skin pass rolling is appropriately performed, the fine irregularities remain in the plateau portions. As a result, the desired image clarity cannot be obtained. The hydrofluoric acid concentration of the treatment solution is therefore 1.0 mass % to 8.0 mass %. The hydrofluoric acid concentration of the treatment solution is preferably 3.0 mass % or more. The hydrofluoric acid concentration of the treatment solution is preferably 4.0 mass % or less.

Nitric Acid Concentration of Treatment Solution: 2.0 Mass % To 12.0 Mass %

If the nitric acid concentration of the treatment solution is less than 2.0 mass %, the formation of fine irregularities on the steel sheet surface is insufficient and the valley portions are not roughened sufficiently, as a result of which the desired whiteness cannot be obtained. If the nitric acid concentration of the treatment solution is more than 12.0 mass %, the formation of fine irregularities on the steel sheet surface is insufficient and the valley portions are not roughened sufficiently, as a result of which the desired whiteness cannot be obtained. The nitric acid concentration of the treatment solution is therefore 2.0 mass % to 12.0 mass %. The nitric acid concentration of the treatment solution is preferably 4.0 mass % or more. The nitric acid concentration of the treatment solution is preferably 7.0 mass % or less.

As long as the aqueous solution (mixed acid aqueous solution) as the treatment solution has the foregoing hydrofluoric acid concentration and nitric acid concentration, the aqueous solution may contain inevitable impurities such as Fe ions and Cr ions, which are common in pickling treatment solutions.

Treatment Temperature (Temperature of Treatment Solution): 30° C. to 65° C.

If the treatment temperature is less than 30° C., the formation of fine irregularities on the steel sheet surface is insufficient and the valley portions are not roughened sufficiently, as a result of which the desired whiteness cannot be obtained. If the treatment temperature is more than 65° C., harmful gas is generated and negatively affects the global environment. In addition, productivity decreases. The treatment temperature is therefore 30° C. to 65° C. The treatment temperature is preferably 45° C. or more. The treatment temperature is preferably 60° C. or less.

Treatment Time (Immersion Time in Treatment Solution): 25 Seconds to 600 Seconds If the treatment time is less than 25 seconds, the formation of fine irregularities on the steel sheet surface is insufficient and the valley portions are not roughened sufficiently, as a result of which the desired whiteness cannot be obtained. If the treatment time is more than 600 seconds, the formation of fine irregularities on the steel sheet surface is excessive and, even when the subsequent skin pass rolling is appropriately performed, the fine irregularities remain in the plateau portions. As a result, the desired image clarity cannot be obtained. The treatment time is therefore 25 seconds to 600 seconds. The treatment time is preferably 40 seconds or more. The treatment time is preferably 100 seconds or less.

Another pickling treatment may be performed before or after the foregoing pickling by the immersion treatment. For example, in the case where cold-rolled sheet annealing is performed in an oxidizing atmosphere, electrolytic treatment using a sodium sulfate aqueous solution may be performed for the purpose of scale removal before the foregoing pickling by the immersion treatment. Immersion treatment in a nitric acid aqueous solution and electrolytic treatment using a nitric acid aqueous solution may be performed for the purpose of passivation treatment after the foregoing pickling by the immersion treatment.

Embodiment 3: Mixed Acid Pickling Single Method

Next, the mixed acid pickling single method of Embodiment 3 will be described below.

(Preparation)

First, a blank steel sheet having Ra of 0.20 μm or less and RSm of 50.0 μm or less is prepared.

Ra of Blank Steel Sheet: 0.20 μm or Less

If Ra of the blank steel sheet is more than 0.20 μm, the surface texture from the blank steel sheet stage remains excessively on the surface of the steel sheet obtained as a finished product even when the below-described pickling and skin pass rolling are performed. That is, the surface roughness of the sheet surface is noticeable and the desired surface roughness resistance cannot be obtained. Ra of the blank steel sheet is therefore 0.20 μm or less. Ra of the blank steel sheet is preferably 0.15 μm or less. Although no lower limit is placed on Ra of the blank steel sheet, Ra of the blank steel sheet is preferably 0.08 μm or more.

RSm of Blank Steel Sheet: 50.0 μm or Less

If RSm of the blank steel sheet is more than 50.0 μm, the streaks from the blank steel sheet stage remaining on the surface of the steel sheet obtained as a finished product promote the surface roughness of the sheet surface, and the desired surface roughness resistance cannot be obtained. RSm of the blank steel sheet is therefore 50.0 μm or less. RSm of the blank steel sheet is preferably 25.0 μm or less. Although no lower limit is placed on RSm of the blank steel sheet, RSm of the blank steel sheet is preferably 5.0 μm or more. Particularly preferably, the blank steel sheet has Ra of 0.15 μm or less and RSm of 25.0 μm or less.

Ra and RSm are measured in accordance with JIS B 0601: 2013. Ra and RSm are measured in a direction perpendicular to the rolling direction of the steel sheet.

The method of preparing the blank steel sheet is not limited. In one aspect, for example, the blank steel sheet can be prepared by subjecting a material for cold rolling such as a hot-rolled steel sheet or a hot-rolled and annealed steel sheet having a predetermined chemical composition, preferably the second chemical composition, to cold rolling wherein a rolling roll (polishing roll) having Ra of 0.20 μm or less and RSm of 50.0 μm or less is used for rolling in the final pass. Cold rolling conditions other than the above are not limited and may be in accordance with conventional methods. For example, the total rolling reduction ratio in cold rolling and the rolling reduction ratio in each rolling pass other than the final pass may be set as appropriate depending on the target sheet thickness of the stainless steel sheet as a finished product. The total rolling reduction ratio in cold rolling is not limited, but is preferably 40% or more from the viewpoint of flattening the shape of the steel sheet. The number of rolling passes is not limited, but is preferably 7 passes to 11 passes, for example. The rolling reduction ratio in the final pass is not limited, but is preferably 12% to 18%, for example. The method of preparing the material for cold rolling such as a hot-rolled steel sheet or a hot-rolled and annealed steel sheet is, for example, the method described in Embodiment 1.

Surface control for the rolling roll typically includes rough polishing intended to remove scratches made on the rolling roll and finish polishing after the rough polishing. Ra can be adjusted to the desired range by finish polishing. RSm takes a large value mainly in the case where intense polishing marks that cannot be removed by finish polishing are locally formed in places on the surface of the rolling roll during rough polishing. In order to remove such intense polishing marks by finish polishing or reduce them to a negligible extent, finish polishing takes a lot of time. Thus, in order to limit RSm to the desired range, it is necessary to prevent the formation of intense polishing marks on the surface of the rolling roll by not setting the pressure of the grindstone against the rolling roll excessively high in rough polishing.

Another method involves, for example, performing cold rolling according to a conventional method and subjecting the surface of the obtained cold-rolled steel sheet to sufficient polishing by using abrasives having grit size of #600 or more to thus adjust the surface texture of the blank steel sheet within the foregoing range.

(Annealing)

Next, the blank steel sheet is annealed to obtain an annealed steel sheet. The annealing conditions are not limited. In one aspect, for example, using a batch annealing furnace or a continuous annealing furnace, the blank steel sheet is held at 800° C. or more and 1050° C. or less for 5 seconds or more and 10 hours or less in an oxidizing atmosphere such as air or a non-oxidizing atmosphere such as nitrogen or ammonia decomposition gas. From the viewpoint of productivity, it is preferable to hold the blank steel sheet for 3 minutes or less in a non-oxidizing atmosphere using a continuous annealing furnace.

(Pickling)

Next, the annealed steel sheet is pickled. In the pickling, immersion treatment is performed under the following treatment conditions:

treatment solution: a mixed acid aqueous solution having a hydrofluoric acid concentration of 1.0 mass % to 8.0 mass % and a nitric acid concentration of 2.0 mass % to 12.0 mass %, treatment temperature: 30° C. to 65° C., and treatment time: 25 seconds to 600 seconds.

Through this treatment, irregularities as valley portions are formed on the surface of the steel sheet, and simultaneously fine irregularities are formed on the surface of the steel sheet to roughen the valley portions.

Hydrofluoric Acid Concentration of Treatment Solution: 1.0 Mass % to 8.0 Mass %

If the hydrofluoric acid concentration of the treatment solution is less than 1.0 mass %, the formation of fine irregularities on the steel sheet surface is insufficient and the valley portions are not roughened sufficiently, as a result of which the desired whiteness cannot be obtained. If the hydrofluoric acid concentration of the treatment solution is more than 8.0 mass %, the formation of fine irregularities on the steel sheet surface is excessive and, even when the subsequent skin pass rolling is appropriately performed, the fine irregularities remain in the plateau portions. As a result, the desired image clarity cannot be obtained. The hydrofluoric acid concentration of the treatment solution is therefore 1.0 mass % to 8.0 mass %.

Nitric Acid Concentration of Treatment Solution: 2.0 Mass % to 12.0 Mass %

If the nitric acid concentration of the treatment solution is less than 2.0 mass %, the formation of fine irregularities on the steel sheet surface is insufficient and the valley portions are not roughened sufficiently, as a result of which the desired whiteness cannot be obtained. If the nitric acid concentration of the treatment solution is more than 12.0 mass %, the formation of fine irregularities on the steel sheet surface is insufficient and the valley portions are not roughened sufficiently, as a result of which the desired whiteness cannot be obtained. The nitric acid concentration of the treatment solution is therefore 2.0 mass % to 12.0 mass %. The nitric acid concentration of the treatment solution is preferably 4.0 mass % or more. The nitric acid concentration of the treatment solution is preferably 7.0 mass % or less.

As long as the aqueous solution (mixed acid aqueous solution) as the treatment solution has the foregoing hydrofluoric acid concentration and nitric acid concentration, the aqueous solution may contain inevitable impurities such as Fe ions and Cr ions, which are common in pickling treatment solutions.

Treatment Temperature (Temperature of Treatment Solution): 30° C. to 65° C.

If the treatment temperature is less than 30° C., the formation of fine irregularities on the steel sheet surface is insufficient and the valley portions are not roughened sufficiently, as a result of which the desired whiteness cannot be obtained. If the treatment temperature is more than 65° C., harmful gas is generated and negatively affects the global environment. In addition, productivity decreases. The treatment temperature is therefore 30° C. to 65° C.

Treatment Time (Immersion Time in Treatment Solution): 25 Seconds to 600 Seconds If the treatment time is less than 25 seconds, the formation of fine irregularities on the steel sheet surface is insufficient and the valley portions are not roughened sufficiently, as a result of which the desired whiteness cannot be obtained. If the treatment time is more than 600 seconds, the formation of fine irregularities on the steel sheet surface is excessive and, even when the subsequent skin pass rolling is appropriately performed, the fine irregularities remain in the plateau portions. As a result, the desired image clarity cannot be obtained. The treatment time is therefore 25 seconds to 600 seconds.

Another pickling treatment may be performed before or after the foregoing pickling by the immersion treatment. For example, in the case where cold-rolled sheet annealing is performed in an oxidizing atmosphere, electrolytic treatment using a sodium sulfate aqueous solution is preferably performed for the purpose of scale removal before the foregoing pickling by the immersion treatment. Immersion treatment in a nitric acid aqueous solution and electrolytic treatment using a nitric acid aqueous solution may be performed for the purpose of passivation treatment after the foregoing pickling by the immersion treatment. In the other pickling treatment, the pickling loss is preferably 5 g/m2 or less.

(Skin Pass Rolling)

Next, the pickled annealed steel sheet is subjected to skin pass rolling. It is important that a dull roll having Ra of 0.09 μm or less is used as the skin pass roll and the elongation ratio is 0.10% to 1.50%. In this way, the convex portions of the irregularities formed on the steel sheet surface by pickling are leveled to form plateau portions, and simultaneously the fine irregularities of the plateau portions are flattened to thus enhance image clarity.

Ra of Skin Pass Roll: 0.09 μm or Less

If Ra of the skin pass roll is more than 0.09 μm, the plateau portions roughened in the pickling cannot be flattened sufficiently, as a result of which the desired image clarity cannot be obtained. Ra of the skin pass roll is therefore 0.09 μm or less. Ra is measured in accordance with JIS B 0601: 2013. Ra is measured in a direction perpendicular to the circumferential direction of the roll surface. In Embodiment 3, the upper limit of Ra of the skin pass roll is lower than that in Embodiments 1 and 2 by the dull rolling method for the following reason. The surface irregularities (B-type surface irregularities) imparted to the sheet surface by mixed acid pickling in Embodiment 3 have concave portions of smaller depth than those of the surface irregularities (A-type surface irregularities) imparted to the sheet surface by dull rolling in the dull rolling method. Therefore, if a skin pass roll with high Ra is used in Embodiment 3, the concave portions are likely to be lost and the desired whiteness cannot be obtained in the finished product. Although no lower limit is placed on Ra of the skin pass roll, Ra of the skin pass roll is preferably 0.01 μm or more.

Elongation Ratio: 0.10% to 1.50%

If the elongation ratio of skin pass rolling is less than 0.10%, the area ratio of the plateau portions on the steel sheet surface is insufficient. As a result, the desired image clarity cannot be obtained. If the elongation ratio of skin pass rolling is more than 1.50%, the area ratio of the valley portions on the steel sheet surface is insufficient. As a result, the desired whiteness cannot be obtained. The elongation ratio is therefore 0.10% to 1.50%.

Skin pass rolling may be performed in one pass or in a plurality of passes. In the case where skin pass rolling is performed in a plurality of passes, the total elongation ratio of the plurality of passes is within the foregoing range (0.10% to 1.50%). The elongation ratio of skin pass rolling (skin pass elongation ratio) (%) is calculated by the following formula:

$$\text{Elongation ratio (\%)} = (\text{length of stainless steel sheet after skin pass rolling})/(\text{length of stainless steel sheet before skin pass rolling}) \times 100 - 100.$$

The roll diameter of the skin pass roll and the steel sheet speed during rolling are not limited. For example, the roll diameter of the skin pass roll is 800 mm to 900 mm, and the steel sheet speed is 40 mpm to 50 mpm. Tension may be applied to the steel sheet during skin pass rolling. The tension is not limited, but is preferably 20 kgf/mm$^2$ or more and 30 kgf/mm$^2$ or less, for example.

Conditions other than the above are not limited and may be in accordance with conventional methods.

EXAMPLES

Example 1

Steels having the chemical compositions (the balance consisting of Fe and inevitable impurities) shown in Table 1 were each melted into a 100 kg steel ingot. After this, the steel ingot was heated at 1150° C. for 1 hour, and then hot rolled to obtain a hot-rolled steel sheet of 3.5 mm in sheet thickness. The hot-rolled steel sheet was subjected to hot-rolled sheet annealing of holding at 900° C. for steel sample IDs 1K and 1P, at 1040° C. for steel sample IDs 1Q and 1U, and at 950° C. for steel sample IDs 1S and IT for 20 seconds, and hot-rolled sheet annealing of holding at 800° C. for 10 hours for the other steel sample IDs, to obtain a hot-rolled and annealed steel sheet. The front and back sides of the hot-rolled and annealed steel sheet were then ground to remove scale, and thus a material for cold rolling was prepared.

Thereafter, the prepared material for cold rolling was subjected to cold rolling under the conditions shown in Table 2 to obtain a cold-rolled steel sheet of 1.0 mm in sheet thickness. The number of rolling passes in the cold rolling was 9 passes to 11 passes in all cases.

The cold-rolled steel sheet was then subjected to cold-rolled sheet annealing to obtain a cold-rolled and annealed steel sheet. For steel sample IDs 1K, 1P, 1Q, 1S, IT, and 1U, the cold-rolled steel sheet was held at 980° C. for 1 minute in a 3.5 vol % hydrogen-96.5 vol % nitrogen atmosphere. For the other steel sample IDs, the cold-rolled steel sheet was held at 850° C. for 1 minute in a 3.5 vol % hydrogen-96.5 vol % nitrogen atmosphere.

The cold-rolled and annealed steel sheet was then subjected to pickling according to Embodiment 1 under the conditions shown in Table 2. The cold-rolled and annealed steel sheet was then subjected to skin pass rolling under the conditions shown in Table 2 to obtain a ferritic stainless steel sheet.

The obtained ferritic stainless steel sheet was cut into 300 mm in length and 200 mm in width, and the steel microstructure was identified and various surface texture parameters (the area ratio of the plateau portions, the area ratio of the valley portions, Sdr of the plateau portions, Sdq of the valley portions, Sal, and Str) were measured in the foregoing manner. The results are shown in Table 2. The measurement of each surface texture and the evaluation of the below-described (i) to (iii) were conducted on both sides of the ferritic stainless steel sheet. Since approximately the same results were obtained on both sides, the results on one side are shown in Table 2 (the same applies to Examples 2 and 3). The chemical composition of each eventually obtained ferritic stainless steel sheet was substantially the same as the chemical composition of the corresponding steel sample ID shown in Table 1, and satisfied the range of the first chemical composition. It was also determined that its microstructure contained ferrite phase with an area ratio of more than 95%.

In the measurement of each surface texture parameter, confocal laser microscope VK250/260 produced by Keyence Corporation was used. Moreover, multi-file analysis application VK-H1XM and analysis application VK-HIXA produced by Keyence Corporation and image analysis software WinROOF2015 produced by Mitani Corporation were used.

In the measurement of each surface texture parameter, a 50-power objective lens with a numerical aperture of 0.55 was used. The upper and lower measurement limits and brightness were automatically set, and the measurement conditions were set to a height pitch of 0.18 μm using a real peak detection (RPD) method. The RPD method is a method in which measurement is performed at a specific height pitch and the true focal height is detected by calculation from the laser beam reflection intensity data obtained at each height. For noise removal in the analysis, DCL correction with a threshold of 5000 and spike removal correction with a height cut level of 100 were used. For separation between the plateau portions and the valley portions, a threshold (separation boundary) was determined based on height data using the mode method.

For each obtained ferritic stainless steel sheet, (i) whiteness, (ii) image clarity, and (iii) surface roughness resistance were evaluated in the foregoing manner based on the following criteria. The evaluation results are shown in Table 2.

(i) Whiteness

◎ (Pass, especially excellent): L' is 60 or more.

○ (Pass): L* is 50 or more and less than 60.

× (Fail): L* is less than 50.

(ii) Image Clarity

◎ (Pass, especially excellent): C(2.0) is 50% or more.

○ (Pass): C(2.0) is 10% or more and less than 50%.

× (Fail): C(2.0) is less than 10%.

(iii) Surface Roughness Resistance

◎ (Pass, especially excellent): Maximum autocorrelation length is 35 μm or less.

○ (Pass): Maximum autocorrelation length is more than 35 μm and 50 μm or less.

× (Fail): Maximum autocorrelation length is more than 50 μm.

In the evaluation of (i) whiteness, CM-600d produced by Konica Minolta, Inc. was used. In the evaluation of (iii) surface roughness resistance, optical microscope DSX-510 produced by Olympus Corporation was used to take sheet surface images. For image processing of the obtained sheet surface images, image analysis software WinROOF2015 produced by Mitani Corporation and Python (open source) were used. For imaging, using MPLFLN5XBDP which is a 5-power objective lens, a bright-field image of a 4.1 mm square region was captured with a pixel count of 1194×1194 by a coaxial epi-illumination method under the conditions of zoom magnification 1× (total magnification 69×), contrast correction ON, automatic exposure, and light brightness 10000. When applying a low-cut filter to the image, the background removal function of WinROOF2015 was used, and the object size was set to 1000 μm. For fast Fourier transform and inverse fast Fourier transform for generating an autocorrelation image, a transformation algorithm (an algorithm implemented in FFTPACK) in Numpy, which is one of the numerical calculation libraries in Python, was used. The reference value for binarizing the autocorrelation image was set to 0.02. In addition, shape feature measurement of WinROOF2015 was used to measure the absolute maximum length of the region to be analyzed.

TABLE 1

| Steel sample | Chemical composition (mass %) | | | | | | | | | |
|---|---|---|---|---|---|---|---|---|---|---|
| ID | C | Si | Mn | P | S | Ni | Cr | Al | N | Others |
| 1A | 0.037 | 0.23 | 0.56 | 0.025 | 0.003 | 0.16 | 16.3 | 0.001 | 0.048 | |
| 1B | 0.018 | 0.14 | 0.78 | 0.028 | 0.004 | 0.17 | 16.1 | 0.003 | 0.035 | |
| 1C | 0.097 | 0.39 | 0.52 | 0.021 | 0.004 | 0.08 | 12.8 | 0.002 | 0.038 | |
| 1D | 0.003 | 0.67 | 0.50 | 0.029 | 0.005 | 0.05 | 16.1 | 0.003 | 0.004 | |
| 1E | 0.144 | 0.52 | 0.38 | 0.021 | 0.006 | 0.15 | 16.4 | 0.003 | 0.084 | |
| 1F | 0.047 | 0.07 | 0.08 | 0.025 | 0.003 | 0.16 | 16.3 | 0.002 | 0.037 | |
| 1G | 0.046 | 1.85 | 0.96 | 0.025 | 0.005 | 0.12 | 16.4 | 0.003 | 0.041 | |
| 1H | 0.044 | 0.53 | 0.38 | 0.025 | 0.006 | 0.24 | 10.6 | 0.003 | 0.047 | |
| 1I | 0.036 | 0.33 | 0.69 | 0.022 | 0.006 | 0.17 | 12.2 | 0.002 | 0.024 | |
| 1J | 0.029 | 0.46 | 0.58 | 0.023 | 0.003 | 0.23 | 21.5 | 0.003 | 0.027 | |
| 1K | 0.005 | 0.22 | 0.49 | 0.030 | 0.006 | 0.22 | 31.3 | 0.003 | 0.008 | |
| 1L | 0.036 | 0.41 | 0.71 | 0.030 | 0.005 | 0.03 | 16.4 | 0.001 | 0.047 | |

TABLE 1-continued

| Steel sample | Chemical composition (mass %) | | | | | | | | | |
|---|---|---|---|---|---|---|---|---|---|---|
| ID | C | Si | Mn | P | S | Ni | Cr | Al | N | Others |
| 1M | 0.052 | 0.35 | 0.34 | 0.020 | 0.001 | 2.30 | 16.0 | 0.573 | 0.043 | |
| 1N | 0.074 | 0.56 | 0.83 | 0.026 | 0.005 | 0.14 | 16.4 | 0.004 | 0.012 | Cu: 0.41 |
| 1O | 0.006 | 0.27 | 0.40 | 0.024 | 0.002 | 0.14 | 10.9 | 0.027 | 0.005 | Ti: 0.25 |
| 1P | 0.004 | 0.11 | 0.06 | 0.019 | 0.002 | 0.15 | 20.3 | 5.978 | 0.003 | Zr: 0.04 |
| 1Q | 0.042 | 0.56 | 0.76 | 0.023 | 0.002 | 0.10 | 16.4 | 0.004 | 0.039 | Nb: 0.15, V: 0.31 |
| 1R | 0.037 | 0.51 | 0.37 | 0.027 | 0.002 | 0.17 | 16.4 | 0.003 | 0.013 | Sn: 0.23 |
| 1S | 0.009 | 0.10 | 0.18 | 0.033 | 0.002 | 0.25 | 21.2 | 0.031 | 0.015 | Cu: 0.43, Ti: 0.32 |
| 1T | 0.072 | 0.08 | 0.15 | 0.027 | 0.001 | 0.15 | 18.1 | 0.034 | 0.008 | Mo: 1.05, Ti: 0.31 |
| 1U | 0.004 | 0.27 | 0.16 | 0.029 | 0.001 | 0.26 | 18.9 | 0.016 | 0.007 | Mo: 1.95, Nb: 0.37 |
| 1V | 0.013 | 0.51 | 0.17 | 0.030 | 0.006 | 0.33 | 19.4 | 0.003 | 0.008 | Cu: 0.45, Nb: 0.45 |
| 1W | 0.030 | 0.50 | 0.46 | 0.029 | 0.005 | 0.20 | 16.2 | 0.003 | 0.035 | Co: 0.36, Mo: 0.15, Ti: 0.38 |
| 1X | 0.053 | 0.44 | 0.42 | 0.026 | 0.003 | 0.06 | 16.3 | 0.002 | 0.024 | W: 0.34, Ca: 0.0008, Y: 0.17, Sb: 0.19 |
| 1Y | 0.072 | 0.66 | 0.68 | 0.022 | 0.002 | 0.28 | 16.3 | 0.004 | 0.028 | Zr: 0.32, B: 0.0025 |
| 1Z | 0.062 | 0.56 | 0.31 | 0.028 | 0.002 | 0.19 | 16.3 | 0.003 | 0.047 | Cu: 0.13, V: 0.08, Mg: 0.0033, Ce: 0.18 |

TABLE 2

| | | Cold rolling | | | | Pickling | | | | | Skin pass rolling | | Surface texture | | | | | | Evaluation results | | | |
|---|---|---|---|---|---|---|---|---|---|---|---|---|---|---|---|---|---|---|---|---|---|---|
| | | | | | Final pass rolling | Treatment solution | | Treatment | | | Skin pass roll | Elongation | Plateau portions | | Valley portions | | | | | | (iii) | |
| | Steel | Final pass roll | | | reduction | Hydrochloric acid | Nitric acid | temperature | Treatment time | Current | | | Area | | Area | | | | (i) | (ii) | Surface | |
| Test No. | sample ID | Ra (μm) | Sal (μm) | Str | ratio (%) | concentration (mass %) | concentration (mass %) | (° C.) | (s) | density (A/dm$^2$) | Ra (μm) | ratio (%) | ratio (%) | Sdr | ratio (%) | Sdq | Sal (μm) | Str | Whiteness | Image clarity | roughness resistance | Remarks |
| 1-1 | 1A | 2.03 | 28.0 | 0.75 | 1.00 | 0.69 | 14.1 | 51 | 11.0 | 13.7 | 0.19 | 0.76 | 54 | 0.051 | 46 | 0.31 | 34.5 | 0.40 | ○ | ○ | ○ | Example |
| 1-2 | 1B | 2.49 | 27.6 | 0.75 | 1.04 | 0.68 | 15.5 | 50 | 11.7 | 12.1 | 0.21 | 0.95 | 43 | 0.080 | 57 | 0.31 | 33.9 | 0.36 | ○ | ○ | ○ | Example |
| 1-3 | 1C | 2.08 | 30.6 | 0.88 | 1.09 | 0.57 | 16.0 | 51 | 11.5 | 13.9 | 0.21 | 0.97 | 50 | 0.051 | 50 | 0.39 | 37.2 | 0.44 | ○ | ○ | ○ | Example |
| 1-4 | 1D | 2.50 | 34.3 | 0.73 | 0.94 | 0.53 | 14.9 | 53 | 11.9 | 12.6 | 0.20 | 0.67 | 41 | 0.061 | 59 | 0.38 | 39.4 | 0.35 | ○ | ○ | ○ | Example |
| 1-5 | 1E | 2.50 | 34.0 | 0.76 | 1.01 | 0.72 | 14.2 | 51 | 10.6 | 12.8 | 0.21 | 0.70 | 42 | 0.061 | 58 | 0.32 | 38.8 | 0.37 | ○ | ○ | ○ | Example |
| 1-6 | 1F | 2.28 | 29.2 | 0.83 | 0.93 | 0.63 | 14.6 | 51 | 10.1 | 12.4 | 0.21 | 0.65 | 50 | 0.064 | 50 | 0.36 | 35.3 | 0.42 | ○ | ○ | ○ | Example |
| 1-7 | 1G | 2.07 | 32.6 | 0.79 | 1.05 | 0.75 | 15.2 | 51 | 11.5 | 13.3 | 0.20 | 0.71 | 58 | 0.071 | 42 | 0.39 | 39.5 | 0.37 | ○ | ○ | ○ | Example |
| 1-8 | 1H | 2.37 | 34.3 | 0.76 | 0.95 | 0.65 | 15.5 | 52 | 10.4 | 11.2 | 0.22 | 0.82 | 59 | 0.064 | 41 | 0.38 | 38.6 | 0.38 | ○ | ○ | ○ | Example |
| 1-9 | 1I | 2.49 | 34.0 | 0.85 | 1.02 | 0.75 | 14.1 | 52 | 10.8 | 11.1 | 0.21 | 0.90 | 40 | 0.052 | 60 | 0.35 | 38.5 | 0.44 | ○ | ○ | ○ | Example |
| 1-10 | 1J | 2.02 | 34.8 | 0.73 | 1.00 | 0.74 | 14.0 | 50 | 11.4 | 12.1 | 0.21 | 0.68 | 58 | 0.063 | 42 | 0.31 | 39.4 | 0.35 | ○ | ○ | ○ | Example |
| 1-11 | 1K | 2.22 | 25.1 | 0.87 | 0.94 | 0.69 | 14.0 | 54 | 12.0 | 11.7 | 0.21 | 0.94 | 58 | 0.059 | 42 | 0.33 | 30.9 | 0.42 | ○ | ○ | ○ | Example |
| 1-12 | 1L | 2.18 | 34.3 | 0.84 | 1.09 | 0.68 | 15.9 | 53 | 11.5 | 13.2 | 0.19 | 0.85 | 52 | 0.069 | 48 | 0.34 | 39.2 | 0.41 | ○ | ○ | ○ | Example |
| 1-13 | 1M | 2.03 | 27.0 | 0.81 | 0.98 | 0.73 | 15.9 | 54 | 11.9 | 11.4 | 0.18 | 0.82 | 45 | 0.079 | 55 | 0.37 | 33.2 | 0.39 | ○ | ○ | ○ | Example |
| 1-14 | 1N | 2.06 | 25.5 | 0.80 | 0.93 | 0.50 | 14.7 | 53 | 10.5 | 14.0 | 0.21 | 0.93 | 46 | 0.075 | 54 | 0.34 | 31.4 | 0.41 | ○ | ○ | ○ | Example |
| 1-15 | 1O | 2.20 | 31.2 | 0.79 | 0.99 | 0.74 | 15.8 | 52 | 11.6 | 13.7 | 0.22 | 0.99 | 40 | 0.054 | 60 | 0.38 | 38.1 | 0.41 | ○ | ○ | ○ | Example |
| 1-16 | 1P | 2.49 | 34.9 | 0.89 | 0.91 | 0.60 | 15.1 | 55 | 10.9 | 11.3 | 0.20 | 0.75 | 51 | 0.069 | 49 | 0.38 | 38.8 | 0.43 | ○ | ○ | ○ | Example |
| 1-17 | 1Q | 2.23 | 31.3 | 0.80 | 1.07 | 0.54 | 15.2 | 55 | 10.5 | 13.6 | 0.20 | 0.90 | 53 | 0.051 | 47 | 0.39 | 38.4 | 0.41 | ○ | ○ | ○ | Example |
| 1-18 | 1R | 2.47 | 34.2 | 0.85 | 0.97 | 0.59 | 15.8 | 52 | 11.6 | 13.9 | 0.20 | 0.80 | 47 | 0.070 | 53 | 0.31 | 39.3 | 0.44 | ○ | ○ | ○ | Example |
| 1-19 | 1S | 2.44 | 31.3 | 0.81 | 0.95 | 0.78 | 14.1 | 52 | 11.6 | 13.5 | 0.22 | 0.74 | 53 | 0.066 | 47 | 0.33 | 38.4 | 0.38 | ○ | ○ | ○ | Example |
| 1-20 | 1T | 2.02 | 29.3 | 0.70 | 1.05 | 0.63 | 14.9 | 54 | 10.2 | 13.7 | 0.20 | 0.91 | 50 | 0.067 | 50 | 0.30 | 35.8 | 0.35 | ○ | ○ | ○ | Example |
| 1-21 | 1U | 2.39 | 28.6 | 0.75 | 1.02 | 0.79 | 15.5 | 54 | 11.2 | 12.8 | 0.21 | 0.80 | 48 | 0.073 | 52 | 0.36 | 34.5 | 0.35 | ○ | ○ | ○ | Example |
| 1-22 | 1V | 2.36 | 30.2 | 0.77 | 1.07 | 0.56 | 14.9 | 53 | 10.7 | 11.9 | 0.20 | 0.93 | 49 | 0.076 | 51 | 0.30 | 36.8 | 0.40 | ○ | ○ | ○ | Example |
| 1-23 | 1W | 2.45 | 32.0 | 0.87 | 0.95 | 0.62 | 14.7 | 52 | 11.5 | 13.2 | 0.20 | 0.91 | 54 | 0.058 | 46 | 0.34 | 39.3 | 0.43 | ○ | ○ | ○ | Example |
| 1-24 | 1X | 2.32 | 32.8 | 0.80 | 0.97 | 0.51 | 15.0 | 54 | 12.0 | 13.7 | 0.18 | 0.86 | 46 | 0.066 | 54 | 0.39 | 40.0 | 0.41 | ○ | ○ | ○ | Example |
| 1-25 | 1Y | 2.06 | 30.7 | 0.86 | 1.03 | 0.64 | 14.1 | 52 | 10.3 | 13.8 | 0.18 | 0.89 | 46 | 0.065 | 54 | 0.38 | 37.6 | 0.41 | ○ | ○ | ○ | Example |
| 1-26 | 1Z | 2.04 | 25.4 | 0.88 | 1.05 | 0.58 | 14.1 | 53 | 10.3 | 11.3 | 0.20 | 0.64 | 45 | 0.053 | 55 | 0.36 | 31.1 | 0.44 | ○ | ○ | ○ | Example |
| 1-27 | 1A | 1.35 | 32.4 | 0.74 | 1.07 | 0.71 | 14.8 | 52 | 11.2 | 11.7 | 0.21 | 0.66 | 64 | 0.064 | 36 | 0.35 | 39.7 | 0.37 | ○ | ○ | ○ | Example |
| 1-28 | 1A | 2.46 | 45.1 | 0.72 | 0.98 | 0.76 | 15.1 | 54 | 11.4 | 11.4 | 0.21 | 0.86 | 55 | 0.053 | 45 | 0.36 | 45.5 | 0.37 | ○ | ○ | ○ | Example |
| 1-29 | 1A | 2.45 | 30.5 | 0.38 | 1.09 | 0.77 | 15.2 | 55 | 10.6 | 11.8 | 0.19 | 0.83 | 50 | 0.066 | 50 | 0.39 | 36.9 | 0.31 | ○ | ○ | ○ | Example |
| 1-30 | 1A | 2.10 | 29.8 | 0.89 | 0.83 | 0.76 | 14.1 | 52 | 10.3 | 13.9 | 0.22 | 0.73 | 65 | 0.071 | 35 | 0.36 | 35.8 | 0.42 | ○ | ○ | ○ | Example |
| 1-31 | 1A | 2.16 | 29.6 | 0.77 | 1.05 | 0.62 | 15.3 | 36 | 11.3 | 12.7 | 0.20 | 0.82 | 42 | 0.069 | 58 | 0.23 | 35.9 | 0.37 | ○ | ○ | ○ | Example |
| 1-32 | 1A | 2.15 | 25.5 | 0.84 | 1.05 | 0.50 | 15.7 | 62 | 10.5 | 11.5 | 0.20 | 0.99 | 48 | 0.090 | 52 | 0.31 | 30.7 | 0.40 | ○ | ○ | ○ | Example |
| 1-33 | 1A | 2.46 | 34.1 | 0.90 | 0.95 | 0.13 | 14.5 | 50 | 11.8 | 13.4 | 0.19 | 0.68 | 58 | 0.050 | 42 | 0.26 | 38.3 | 0.44 | ○ | ○ | ○ | Example |
| 1-34 | 1A | 2.22 | 27.4 | 0.70 | 0.92 | 4.85 | 14.3 | 54 | 10.3 | 12.7 | 0.20 | 0.63 | 44 | 0.085 | 56 | 0.32 | 33.4 | 0.35 | ○ | ○ | ○ | Example |
| 1-35 | 1A | 2.28 | 32.4 | 0.70 | 1.02 | 0.54 | 10.4 | 50 | 11.3 | 11.4 | 0.19 | 0.66 | 50 | 0.055 | 50 | 0.24 | 39.0 | 0.35 | ○ | ○ | ○ | Example |
| 1-36 | 1A | 2.39 | 28.7 | 0.85 | 1.02 | 0.56 | 19.2 | 52 | 11.3 | 12.7 | 0.19 | 0.93 | 50 | 0.095 | 50 | 0.33 | 34.7 | 0.42 | ○ | ○ | ○ | Example |
| 1-37 | 1A | 2.20 | 32.4 | 0.71 | 0.98 | 0.61 | 14.9 | 53 | 10.6 | 5.5 | 0.20 | 0.85 | 46 | 0.059 | 54 | 0.27 | 39.9 | 0.36 | ○ | ○ | ○ | Example |
| 1-38 | 1A | 2.15 | 27.0 | 0.76 | 1.03 | 0.60 | 15.0 | 54 | 11.8 | 19.6 | 0.19 | 0.68 | 41 | 0.092 | 59 | 0.36 | 33.2 | 0.38 | ○ | ○ | ○ | Example |

TABLE 2-continued

| | | Cold rolling | | | | Pickling | | | | | Skin pass rolling | | Surface texture | | | | | | Evaluation results | | | |
|---|---|---|---|---|---|---|---|---|---|---|---|---|---|---|---|---|---|---|---|---|---|---|
| | | | | | Final pass rolling | Treatment solution | | Treatment temperature | Treatment time | | Skin pass roll | Elongation | Plateau portions | | Valley portions | | | | | | (iii) | |
| Test No. | Steel sample ID | Final pass roll Ra (μm) | Final pass roll Sal (μm) | Final pass roll Str | reduction ratio (%) | Hydrochloric acid concentration (mass %) | Nitric acid concentration (mass %) | (° C.) | (s) | Current density (A/dm$^2$) | Ra (μm) | ratio (%) | Area ratio (%) | Sdr | Area ratio (%) | Sdq | Sal (μm) | Str | (i) Whiteness | (ii) Image clarity | Surface roughness resistance | Remarks |
| 1-39 | 1A | 2.11 | 33.2 | 0.82 | 0.95 | 0.56 | 15.1 | 55 | 1.2 | 11.4 | 0.18 | 0.83 | 43 | 0.076 | 57 | 0.26 | 37.8 | 0.41 | ○ | ○ | ○ | Example |
| 1-40 | 1A | 2.22 | 27.7 | 0.89 | 1.06 | 0.55 | 15.0 | 54 | 57.8 | 11.5 | 0.18 | 0.76 | 45 | 0.089 | 55 | 0.33 | 34.0 | 0.44 | ○ | ○ | ○ | Example |
| 1-41 | 1A | 2.16 | 33.1 | 0.83 | 1.01 | 0.78 | 15.9 | 55 | 10.3 | 12.3 | 0.28 | 0.92 | 52 | 0.097 | 48 | 0.35 | 40.0 | 0.40 | ○ | ○ | ○ | Example |
| 1-42 | 1A | 2.10 | 30.9 | 0.75 | 1.08 | 0.73 | 15.0 | 55 | 10.5 | 11.7 | 0.21 | 0.15 | 34 | 0.077 | 66 | 0.35 | 37.6 | 0.38 | ○ | ○ | ○ | Example |
| 1-43 | 1A | 2.02 | 33.0 | 0.81 | 0.97 | 0.63 | 14.7 | 53 | 10.1 | 13.4 | 0.21 | 2.79 | 66 | 0.065 | 34 | 0.39 | 39.5 | 0.38 | ○ | ○ | ○ | Example |
| 1-44 | 1A | 0.79 | 29.8 | 0.73 | 1.00 | 0.59 | 14.9 | 52 | 10.5 | 11.5 | 0.19 | 0.73 | 78 | 0.060 | 22 | 0.39 | 36.6 | 0.36 | X | ○ | ○ | Comparative Example |
| 1-45 | 1A | 2.02 | 71.3 | 0.74 | 0.94 | 0.74 | 15.4 | 50 | 10.6 | 11.6 | 0.19 | 0.63 | 57 | 0.065 | 43 | 0.34 | 88.3 | 0.36 | ○ | ○ | X | Comparative Example |
| 1-46 | 1A | 2.35 | 34.5 | 0.17 | 0.96 | 0.53 | 15.6 | 54 | 10.9 | 11.1 | 0.21 | 0.70 | 58 | 0.055 | 42 | 0.32 | 38.7 | 0.22 | ○ | ○ | X | Comparative Example |
| 1-47 | 1A | 2.31 | 34.7 | 0.72 | 0.63 | 0.57 | 15.5 | 52 | 10.5 | 11.5 | 0.20 | 0.77 | 77 | 0.059 | 23 | 0.31 | 37.2 | 0.37 | X | ○ | ○ | Comparative Example |
| 1-48 | 1A | 2.27 | 26.6 | 0.71 | 1.04 | 0.56 | 14.8 | 24 | 11.1 | 13.9 | 0.21 | 0.73 | 53 | 0.077 | 47 | 0.13 | 32.8 | 0.35 | X | ○ | ○ | Comparative Example |
| 1-49 | 1A | 2.09 | 34.2 | 0.83 | 0.92 | 0.56 | 14.8 | 78 | 10.7 | 11.9 | 0.20 | 0.84 | 54 | 0.179 | 46 | 0.33 | 38.9 | 0.41 | ○ | X | ○ | Comparative Example |
| 1-50 | 1A | 2.22 | 29.6 | 0.73 | 1.02 | 0.03 | 15.4 | 51 | 10.1 | 12.5 | 0.20 | 0.75 | 41 | 0.078 | 59 | 0.12 | 35.6 | 0.39 | X | ○ | ○ | Comparative Example |
| 1-51 | 1A | 2.46 | 27.0 | 0.75 | 0.98 | 5.24 | 15.7 | 53 | 11.9 | 12.8 | 0.19 | 0.92 | 55 | 0.167 | 45 | 0.36 | 32.6 | 0.38 | ○ | X | ○ | Comparative Example |
| 1-52 | 1A | 2.24 | 27.9 | 0.70 | 0.94 | 0.61 | 8.6 | 51 | 11.1 | 13.5 | 0.21 | 0.79 | 51 | 0.056 | 49 | 0.17 | 34.2 | 0.37 | X | ○ | ○ | Comparative Example |
| 1-53 | 1A | 2.39 | 29.4 | 0.75 | 0.98 | 0.68 | 22.8 | 52 | 10.7 | 13.9 | 0.20 | 0.92 | 52 | 0.154 | 48 | 0.32 | 35.5 | 0.37 | ○ | X | ○ | Comparative Example |
| 1-54 | 1A | 2.43 | 25.8 | 0.76 | 0.90 | 0.52 | 14.7 | 52 | 10.4 | 4.0 | 0.20 | 0.68 | 49 | 0.057 | 51 | 0.13 | 31.3 | 0.38 | X | ○ | ○ | Comparative Example |
| 1-55 | 1A | 2.30 | 34.9 | 0.75 | 0.93 | 0.58 | 15.6 | 52 | 11.0 | 21.9 | 0.18 | 0.92 | 47 | 0.158 | 53 | 0.37 | 37.0 | 0.35 | ○ | X | ○ | Comparative Example |
| 1-56 | 1A | 2.49 | 28.9 | 0.85 | 0.95 | 0.60 | 14.4 | 54 | 0.4 | 13.7 | 0.20 | 0.84 | 51 | 0.078 | 49 | 0.15 | 34.8 | 0.44 | X | ○ | ○ | Comparative Example |
| 1-57 | 1A | 2.04 | 25.5 | 0.84 | 1.08 | 0.52 | 14.9 | 54 | 73.8 | 12.8 | 0.22 | 0.89 | 50 | 0.162 | 50 | 0.34 | 31.0 | 0.42 | ○ | X | ○ | Comparative Example |
| 1-58 | 1A | 2.10 | 26.0 | 0.83 | 1.08 | 0.78 | 15.6 | 53 | 10.9 | 11.9 | 0.39 | 0.67 | 44 | 0.153 | 56 | 0.37 | 32.0 | 0.39 | ○ | X | ○ | Comparative Example |
| 1-59 | 1A | 2.16 | 26.6 | 0.89 | 1.09 | 0.59 | 15.4 | 53 | 11.8 | 13.2 | 0.20 | 0.03 | 12 | 0.075 | 88 | 0.36 | 32.3 | 0.43 | ○ | X | ○ | Comparative Example |
| 1-60 | 1A | 2.26 | 34.5 | 0.85 | 0.98 | 0.63 | 15.3 | 54 | 11.6 | 11.0 | 0.21 | 3.82 | 74 | 0.071 | 26 | 0.38 | 39.4 | 0.41 | X | ○ | ○ | Comparative Example |

As shown in Table 2, all Examples satisfied the required characteristics of (i), (ii), and (iii) above.

On the other hand, all Comparative Examples failed to satisfy at least one of the required characteristics (i), (ii), and (iii).

In Comparative Example of test No. 1-44, since Ra of the final pass roll in cold rolling was below the appropriate range, the area ratio of the valley portions was low and the desired whiteness could not be obtained.

In Comparative Example of test No. 1-45, since Sal of the final pass roll in cold rolling was above the appropriate range, Sal of the steel sheet surface was high, so that the desired surface roughness resistance could not be obtained and surface roughness was noticeable.

In Comparative Example of test No. 1-46, since Str of the final pass roll in cold rolling was below the appropriate range, Str of the steel sheet surface was low, so that the desired surface roughness resistance could not be obtained and surface roughness was noticeable.

In Comparative Example of test No. 1-47, since the rolling reduction ratio in the final pass in cold rolling was below the appropriate range, the area ratio of the valley portions was low and the desired whiteness could not be obtained.

In Comparative Example of test No. 1-48, since the treatment temperature was below the appropriate range, Sdq of the valley portions was low and the desired whiteness could not be obtained.

In Comparative Example of test No. 1-49, since the treatment temperature was above the appropriate range, Sdr of the plateau portions was high and the desired image clarity could not be obtained.

In Comparative Example of test No. 1-50, since the hydrochloric acid concentration of the treatment solution was below the appropriate range, Sdq of the valley portions was low and the desired whiteness could not be obtained.

In Comparative Example of test No. 1-51, since the hydrochloric acid concentration of the treatment solution was above the appropriate range, Sdr of the plateau portions was high and the desired image clarity could not be obtained.

In Comparative Example of test No. 1-52, since the nitric acid concentration of the treatment solution was below the appropriate range, Sdq of the valley portions was low and the desired whiteness could not be obtained.

In Comparative Example of test No. 1-53, since the nitric acid concentration of the treatment solution was above the appropriate range, Sdr of the plateau portions was high and the desired image clarity could not be obtained.

In Comparative Example of test No. 1-54, since the current density was below the appropriate range, Sdq of the valley portions was low and the desired whiteness could not be obtained.

In Comparative Example of test No. 1-55, since the current density was above the appropriate range, Sdr of the plateau portions was high and the desired image clarity could not be obtained.

In Comparative Example of test No. 1-56, since the treatment time was below the appropriate range, Sdq of the valley portions was low and the desired whiteness could not be obtained.

In Comparative Example of test No. 1-57, since the treatment time was above the appropriate range, Sdr of the plateau portions was high and the desired image clarity could not be obtained.

In Comparative Example of test No. 1-58, since Ra of the skin pass roll was above the appropriate range, Sdr of the plateau portions was high and the desired image clarity could not be obtained.

In Comparative Example of test No. 1-59, since the elongation ratio of skin pass rolling was below the appropriate range, the area ratio of the plateau portions was low and the desired image clarity could not be obtained.

In Comparative Example of test No. 1-60, since the elongation ratio of skin pass rolling was above the appropriate range, the area ratio of the valley portions was low and the desired whiteness could not be obtained.

Example 2

Cold-rolled and annealed steel sheets obtained in the same manner as in Example 1 (the cold rolling conditions are shown in Table 3) were each subjected to pickling according to Embodiment 2 under the conditions shown in Table 3. The cold-rolled and annealed steel sheet was then subjected to skin pass rolling under the conditions shown in Table 3 to obtain a ferritic stainless steel sheet.

The obtained ferritic stainless steel sheet was cut into 300 mm in length and 200 mm in width, and the steel microstructure was identified and various surface texture parameters (the area ratio of the plateau portions, the area ratio of the valley portions, Sdr of the plateau portions, Sdq of the valley portions, Sal, and Str) were measured in the same manner as in Example 1. The results are shown in Table 3. The chemical composition of each eventually obtained ferritic stainless steel sheet was substantially the same as the chemical composition of the corresponding steel sample ID shown in Table 1, and satisfied the range of the first chemical composition. It was also determined 5 that its microstructure contained ferrite phase with an area ratio of more than 95%.

For each obtained ferritic stainless steel sheet, (i) whiteness, (ii) image clarity, and (iii) surface roughness resistance were evaluated in the same manner as in Example 1 based on the same criteria as in Example 1. The results are shown in Table 3.

TABLE 3

| Test No. | Steel sample ID | Cold rolling: Final pass roll Ra (μm) | Final pass roll Sal (μm) | Final pass roll Str | Final pass rolling reduction ratio (%) | Pickling: Treatment solution: Hydrofluoric acid concentration (mass %) | Nitric acid concentration (mass %) | Treatment temperature (° C.) | Treatment time (s) | Skin pass rolling: Skin pass roll Ra (μm) | Elongation ratio (%) | Surface texture: Plateau portions Area ratio (%) | Plateau portions Sdr | Valley portions Area ratio (%) | Valley portions Sdq | Sal (μm) | Str | Evaluation results: (i) Whiteness | (ii) Image clarity | (iii) Surface roughness resistance | Remarks |
|---|---|---|---|---|---|---|---|---|---|---|---|---|---|---|---|---|---|---|---|---|---|
| 2-1 | 1A | 2.03 | 28.0 | 0.75 | 1.00 | 3.1 | 5.9 | 49 | 55 | 0.19 | 0.74 | 49 | 0.074 | 51 | 0.48 | 39.2 | 0.37 | ◎ | ○ | ○ | Example |
| 2-2 | 1B | 2.49 | 27.6 | 0.75 | 1.04 | 3.6 | 5.8 | 59 | 51 | 0.19 | 0.96 | 45 | 0.057 | 55 | 0.47 | 35.3 | 0.44 | ◎ | ○ | ○ | Example |
| 2-3 | 1C | 2.08 | 30.6 | 0.88 | 1.09 | 3.9 | 6.2 | 52 | 48 | 0.21 | 0.76 | 53 | 0.067 | 47 | 0.63 | 37.9 | 0.42 | ◎ | ○ | ○ | Example |
| 2-4 | 1D | 2.50 | 34.3 | 0.73 | 0.94 | 3.4 | 6.8 | 47 | 54 | 0.20 | 0.87 | 56 | 0.058 | 44 | 0.51 | 39.3 | 0.43 | ◎ | ○ | ○ | Example |
| 2-5 | 1E | 2.50 | 34.0 | 0.76 | 1.01 | 3.3 | 4.7 | 48 | 48 | 0.21 | 0.77 | 51 | 0.079 | 49 | 0.61 | 39.8 | 0.38 | ◎ | ○ | ○ | Example |
| 2-6 | 1F | 2.28 | 29.2 | 0.83 | 0.93 | 3.8 | 4.9 | 51 | 56 | 0.19 | 0.95 | 48 | 0.067 | 52 | 0.55 | 34.2 | 0.36 | ◎ | ○ | ○ | Example |
| 2-7 | 1G | 2.07 | 32.6 | 0.79 | 1.05 | 3.5 | 5.1 | 54 | 47 | 0.20 | 0.79 | 48 | 0.068 | 52 | 0.58 | 39.9 | 0.39 | ◎ | ○ | ○ | Example |
| 2-8 | 1H | 2.37 | 34.3 | 0.76 | 0.95 | 3.5 | 6.0 | 57 | 54 | 0.20 | 0.68 | 51 | 0.078 | 49 | 0.59 | 30.9 | 0.44 | ◎ | ○ | ○ | Example |
| 2-9 | 1I | 2.49 | 34.0 | 0.85 | 1.02 | 3.8 | 4.8 | 47 | 53 | 0.22 | 0.68 | 51 | 0.057 | 49 | 0.47 | 35.6 | 0.41 | ◎ | ○ | ○ | Example |
| 2-10 | 1J | 2.02 | 34.8 | 0.73 | 1.00 | 3.5 | 6.5 | 56 | 79 | 0.19 | 0.84 | 44 | 0.067 | 56 | 0.53 | 31.9 | 0.40 | ◎ | ○ | ○ | Example |
| 2-11 | 1K | 2.22 | 25.1 | 0.87 | 0.94 | 3.8 | 4.3 | 48 | 92 | 0.18 | 0.75 | 42 | 0.052 | 58 | 0.54 | 39.6 | 0.41 | ◎ | ○ | ○ | Example |
| 2-12 | 1L | 2.18 | 34.3 | 0.84 | 1.09 | 4.0 | 4.3 | 54 | 52 | 0.19 | 0.85 | 56 | 0.051 | 44 | 0.65 | 38.5 | 0.42 | ◎ | ○ | ○ | Example |
| 2-13 | 1M | 2.03 | 27.0 | 0.81 | 0.98 | 3.5 | 4.6 | 57 | 57 | 0.22 | 0.88 | 42 | 0.052 | 58 | 0.61 | 38.9 | 0.39 | ◎ | ○ | ○ | Example |
| 2-14 | 1N | 2.06 | 25.5 | 0.80 | 0.93 | 3.8 | 5.2 | 59 | 49 | 0.22 | 0.65 | 51 | 0.077 | 49 | 0.53 | 37.0 | 0.38 | ◎ | ○ | ○ | Example |
| 2-15 | 1O | 2.20 | 31.2 | 0.79 | 0.99 | 3.3 | 4.8 | 52 | 55 | 0.22 | 0.61 | 54 | 0.076 | 46 | 0.59 | 31.6 | 0.39 | ◎ | ○ | ○ | Example |
| 2-16 | 1P | 2.49 | 34.9 | 0.89 | 0.91 | 3.3 | 4.9 | 47 | 50 | 0.22 | 0.73 | 51 | 0.051 | 49 | 0.49 | 32.7 | 0.41 | ◎ | ○ | ○ | Example |
| 2-17 | 1Q | 2.23 | 31.3 | 0.80 | 1.07 | 4.0 | 6.7 | 47 | 46 | 0.19 | 0.65 | 54 | 0.078 | 46 | 0.52 | 31.1 | 0.44 | ◎ | ○ | ○ | Example |
| 2-18 | 1R | 2.47 | 34.2 | 0.85 | 0.97 | 3.5 | 5.6 | 51 | 54 | 0.21 | 0.76 | 51 | 0.059 | 49 | 0.56 | 37.2 | 0.36 | ◎ | ○ | ○ | Example |
| 2-19 | 1S | 2.44 | 31.3 | 0.81 | 0.95 | 3.4 | 5.2 | 58 | 50 | 0.20 | 0.66 | 43 | 0.053 | 57 | 0.52 | 32.4 | 0.39 | ◎ | ○ | ○ | Example |
| 2-20 | 1T | 2.02 | 29.3 | 0.70 | 1.05 | 3.9 | 4.0 | 58 | 48 | 0.20 | 0.89 | 45 | 0.069 | 55 | 0.45 | 39.3 | 0.38 | ◎ | ○ | ○ | Example |
| 2-21 | 1U | 2.39 | 28.6 | 0.75 | 1.02 | 3.9 | 5.8 | 50 | 57 | 0.21 | 0.80 | 52 | 0.076 | 48 | 0.56 | 39.3 | 0.37 | ◎ | ○ | ○ | Example |
| 2-22 | 1V | 2.36 | 30.2 | 0.77 | 1.07 | 3.6 | 6.5 | 49 | 48 | 0.18 | 0.85 | 53 | 0.055 | 47 | 0.52 | 37.9 | 0.44 | ◎ | ○ | ○ | Example |
| 2-23 | 1W | 2.45 | 32.0 | 0.87 | 0.95 | 3.3 | 6.4 | 53 | 52 | 0.18 | 0.95 | 49 | 0.067 | 51 | 0.59 | 39.9 | 0.40 | ◎ | ○ | ○ | Example |
| 2-24 | 1X | 2.32 | 32.8 | 0.80 | 0.97 | 3.2 | 5.8 | 57 | 59 | 0.21 | 0.66 | 57 | 0.071 | 43 | 0.46 | 38.2 | 0.42 | ◎ | ○ | ○ | Example |
| 2-25 | 1Y | 2.06 | 30.7 | 0.86 | 1.03 | 3.5 | 6.0 | 57 | 58 | 0.22 | 0.93 | 59 | 0.065 | 41 | 0.47 | 37.1 | 0.44 | ◎ | ○ | ○ | Example |
| 2-26 | 1Z | 2.04 | 25.4 | 0.88 | 1.05 | 3.8 | 5.6 | 56 | 46 | 0.20 | 0.94 | 41 | 0.066 | 59 | 0.64 | 37.1 | 0.38 | ◎ | ○ | ○ | Example |
| 2-27 | 1A | 1.35 | 32.4 | 0.74 | 1.07 | 3.6 | 6.9 | 51 | 50 | 0.20 | 0.63 | 64 | 0.073 | 36 | 0.63 | 37.4 | 0.40 | ◎ | ○ | ○ | Example |
| 2-28 | 1A | 2.46 | 45.1 | 0.72 | 0.98 | 4.0 | 4.8 | 56 | 48 | 0.21 | 0.67 | 55 | 0.069 | 45 | 0.51 | 46.5 | 0.39 | ◎ | ○ | ○ | Example |
| 2-29 | 1A | 2.45 | 30.5 | 0.38 | 1.09 | 3.3 | 6.4 | 47 | 58 | 0.20 | 0.71 | 54 | 0.068 | 46 | 0.58 | 37.3 | 0.32 | ◎ | ○ | ○ | Example |
| 2-30 | 1A | 2.10 | 29.8 | 0.89 | 0.83 | 3.2 | 4.0 | 47 | 51 | 0.22 | 0.98 | 62 | 0.056 | 38 | 0.48 | 34.9 | 0.41 | ◎ | ○ | ○ | Example |
| 2-31 | 1A | 2.16 | 29.6 | 0.77 | 1.05 | 3.2 | 5.6 | 34 | 57 | 0.18 | 0.88 | 47 | 0.069 | 53 | 0.38 | 36.3 | 0.33 | ○ | ○ | ○ | Example |
| 2-32 | 1A | 2.15 | 25.5 | 0.84 | 1.05 | 3.6 | 6.2 | 64 | 46 | 0.19 | 0.81 | 45 | 0.094 | 55 | 0.54 | 39.6 | 0.40 | ◎ | ○ | ○ | Example |
| 2-33 | 1A | 2.46 | 34.1 | 0.90 | 0.95 | 1.2 | 6.9 | 52 | 48 | 0.19 | 0.93 | 47 | 0.070 | 53 | 0.33 | 30.7 | 0.33 | ○ | ○ | ○ | Example |
| 2-34 | 1A | 2.22 | 27.4 | 0.70 | 0.92 | 7.3 | 5.5 | 55 | 47 | 0.20 | 0.72 | 40 | 0.053 | 60 | 0.34 | 34.4 | 0.39 | ◎ | ○ | ○ | Example |
| 2-35 | 1A | 2.28 | 32.4 | 0.70 | 1.02 | 3.4 | 2.5 | 56 | 47 | 0.22 | 0.78 | 55 | 0.068 | 45 | 0.36 | 35.0 | 0.39 | ○ | ○ | ○ | Example |
| 2-36 | 1A | 2.39 | 28.7 | 0.85 | 1.02 | 3.9 | 11.2 | 50 | 46 | 0.19 | 0.87 | 50 | 0.088 | 50 | 0.63 | 38.5 | 0.43 | ○ | ○ | ○ | Example |
| 2-37 | 1A | 2.20 | 32.4 | 0.71 | 0.98 | 3.8 | 4.8 | 49 | 27 | 0.19 | 0.96 | 51 | 0.066 | 49 | 0.50 | 39.0 | 0.42 | ○ | ○ | ○ | Example |
| 2-38 | 1A | 2.15 | 27.0 | 0.76 | 1.03 | 3.6 | 4.4 | 52 | 557 | 0.18 | 0.81 | 49 | 0.067 | 51 | 0.61 | 36.9 | 0.36 | ◎ | ○ | ○ | Example |

TABLE 3-continued

| | | Cold rolling | | | | Pickling | | | | Skin pass rolling | | Surface texture | | | | | | Evaluation results | | | |
|---|---|---|---|---|---|---|---|---|---|---|---|---|---|---|---|---|---|---|---|---|---|
| | | | | | Final pass rolling | Treatment solution | | Treatment | | | | Plateau portions | | Valley portions | | | | | | (iii) | |
| | Steel | Final pass roll | | | reduction | Hydrofluoric acid | Nitric acid concen- | temper- | Treat- ment | Skin pass roll | Elongation | Area | | Area | | | | (i) | (ii) | Surface | |
| Test No. | sample ID | Ra (μm) | Sal (μm) | Str | ratio (%) | concentration (mass %) | tration (mass %) | ature (° C.) | time (s) | Ra (μm) | ratio (%) | ratio (%) | Sdr | ratio (%) | Sdq | Sal (μm) | Str | White- ness | Image clarity | roughness resistance | Remarks |
| 2-39 | 1A | 2.16 | 33.1 | 0.83 | 1.01 | 3.9 | 5.3 | 48 | 51 | 0.29 | 0.94 | 57 | 0.096 | 43 | 0.51 | 38.5 | 0.35 | ◎ | ○ | ○ | Example |
| 2-40 | 1A | 2.10 | 30.9 | 0.75 | 1.08 | 3.7 | 5.8 | 52 | 49 | 0.18 | 0.17 | 36 | 0.063 | 64 | 0.48 | 37.0 | 0.44 | ◎ | ○ | ○ | Example |
| 2-41 | 1A | 2.02 | 33.0 | 0.81 | 0.97 | 3.1 | 5.0 | 55 | 50 | 0.22 | 2.85 | 68 | 0.079 | 32 | 0.47 | 37.9 | 0.40 | ○ | ○ | ○ | Example |
| 2-42 | 1A | 0.79 | 29.8 | 0.73 | 1.00 | 3.6 | 5.1 | 55 | 45 | 0.21 | 0.73 | 78 | 0.075 | 22 | 0.49 | 36.2 | 0.39 | X | ○ | ○ | Comparative Example |
| 2-43 | 1A | 2.02 | 71.3 | 0.74 | 0.94 | 3.1 | 4.8 | 48 | 49 | 0.21 | 0.62 | 54 | 0.060 | 46 | 0.57 | 76.2 | 0.44 | ◎ | ○ | X | Comparative Example |
| 2-44 | 1A | 2.35 | 34.5 | 0.17 | 0.96 | 3.1 | 6.4 | 54 | 49 | 0.18 | 0.75 | 47 | 0.057 | 53 | 0.55 | 33.5 | 0.22 | ◎ | ○ | X | Comparative Example |
| 2-45 | 1A | 2.31 | 34.7 | 0.72 | 0.63 | 3.1 | 4.4 | 58 | 49 | 0.19 | 0.72 | 77 | 0.055 | 23 | 0.53 | 38.8 | 0.40 | X | ○ | ○ | Comparative Example |
| 2-46 | 1A | 2.27 | 26.6 | 0.71 | 1.04 | 3.6 | 6.4 | 22 | 47 | 0.18 | 0.78 | 40 | 0.075 | 60 | 0.14 | 35.5 | 0.38 | X | ○ | ○ | Comparative Example |
| 2-47 | 1A | 2.09 | 34.2 | 0.83 | 0.92 | 0.5 | 4.7 | 58 | 46 | 0.21 | 0.73 | 49 | 0.075 | 51 | 0.17 | 36.7 | 0.44 | X | ○ | ○ | Comparative Example |
| 2-48 | 1A | 2.22 | 29.6 | 0.73 | 1.02 | 9.8 | 4.0 | 58 | 48 | 0.20 | 0.68 | 44 | 0.139 | 56 | 0.52 | 32.9 | 0.40 | ◎ | X | ○ | Comparative Example |
| 2-49 | 1A | 2.46 | 27.0 | 0.75 | 0.98 | 3.8 | 1.4 | 49 | 50 | 0.21 | 0.79 | 52 | 0.062 | 48 | 0.16 | 33.0 | 0.39 | X | ○ | ○ | Comparative Example |
| 2-50 | 1A | 2.24 | 27.9 | 0.70 | 0.94 | 3.6 | 13.4 | 48 | 45 | 0.19 | 0.87 | 52 | 0.075 | 48 | 0.12 | 33.8 | 0.42 | X | ○ | ○ | Comparative Example |
| 2-51 | 1A | 2.39 | 29.4 | 0.75 | 0.98 | 4.0 | 6.3 | 55 | 15 | 0.21 | 0.81 | 54 | 0.053 | 46 | 0.11 | 37.6 | 0.39 | X | ○ | ○ | Comparative Example |
| 2-52 | 1A | 2.43 | 25.8 | 0.76 | 0.90 | 3.7 | 5.2 | 58 | 706 | 0.20 | 0.88 | 58 | 0.153 | 42 | 0.63 | 35.0 | 0.38 | ◎ | X | ○ | Comparative Example |
| 2-53 | 1A | 2.10 | 26.0 | 0.83 | 1.08 | 3.9 | 5.5 | 51 | 47 | 0.40 | 0.63 | 42 | 0.146 | 58 | 0.57 | 38.3 | 0.44 | ○ | X | ○ | Comparative Example |
| 2-54 | 1A | 2.16 | 26.6 | 0.89 | 1.09 | 3.5 | 6.5 | 56 | 55 | 0.21 | 0.04 | 22 | 0.072 | 78 | 0.53 | 35.9 | 0.42 | ○ | X | ○ | Comparative Example |
| 2-55 | 1A | 2.26 | 34.5 | 0.85 | 0.98 | 3.4 | 5.8 | 48 | 54 | 0.21 | 3.37 | 74 | 0.073 | 26 | 0.51 | 36.2 | 0.37 | X | ○ | ○ | Comparative Example |

As shown in Table 3, all Examples satisfied the required characteristics of (i), (ii), and (iii) above. In all Examples in (Example 2) produced by the dull rolling mixed acid immersion method of Embodiment 2, the whiteness was evaluated higher than or equal to that in Examples in (Example 1) produced by the dull rolling nitrohydrochloric acid electrolysis method of Embodiment 1. The whiteness was evaluated particularly high in Examples produced under preferable production conditions (test Nos. 2-1 to 2-26).

On the other hand, all Comparative Examples failed to satisfy at least one of the required characteristics (i), (ii), and (iii).

In Comparative Example of test No. 2-42, since Ra of the final pass roll in cold rolling was below the appropriate range, the area ratio of the valley portions was low and the desired whiteness could not be obtained.

In Comparative Example of test No. 2-43, since Sal of the final pass roll in cold rolling was above the appropriate range, Sal of the steel sheet surface was high, so that the desired surface roughness resistance could not be obtained and surface roughness was noticeable.

In Comparative Example of test No. 2-44, since Str of the final pass roll in cold rolling was below the appropriate range, Str of the steel sheet surface was low, so that the desired surface roughness resistance could not be obtained and surface roughness was noticeable.

In Comparative Example of test No. 2-45, since the rolling reduction ratio in the final pass in cold rolling was below the appropriate range, the area ratio of the valley portions was low and the desired whiteness could not be obtained.

In Comparative Example of test No. 2-46, since the treatment temperature was below the appropriate range, Sdq of the valley portions was low and the desired whiteness could not be obtained.

In Comparative Example of test No. 2-47, since the hydrofluoric acid concentration of the treatment solution was below the appropriate range, Sdq of the valley portions was low and the desired whiteness could not be obtained.

In Comparative Example of test No. 2-48, since the hydrofluoric acid concentration of the treatment solution was above the appropriate range, Sdr of the plateau portions was high and the desired image clarity could not be obtained.

In Comparative Example of test No. 2-49, since the nitric acid concentration of the treatment solution was below the appropriate range, Sdq of the valley portions was low and the desired whiteness could not be obtained.

In Comparative Example of test No. 2-50, since the nitric acid concentration of the treatment solution was above the appropriate range, Sdq of the valley portions was low and the desired whiteness could not be obtained.

In Comparative Example of test No. 2-51, since the treatment time was below the appropriate range, Sdq of the valley portions was low and the desired whiteness could not be obtained.

In Comparative Example of test No. 2-52, since the treatment time was above the appropriate range, Sdr of the plateau portions was high and the desired image clarity could not be obtained.

In Comparative Example of test No. 2-53, since Ra of the skin pass roll was above the appropriate range, Sdr of the plateau portions was high and the desired image clarity could not be obtained.

In Comparative Example of test No. 2-54, since the elongation ratio of skin pass rolling was below the appropriate range, the area ratio of the plateau portions was low and the desired image clarity could not be obtained.

In Comparative Example of test No. 2-55, since the elongation ratio of skin pass rolling was above the appropriate range, the area ratio of the valley portions was low and the desired whiteness could not be obtained.

Example 3

Steels having the chemical compositions (the balance consisting of Fe and inevitable impurities) shown in Table 4 were each melted into a 100 kg steel ingot. After this, the steel ingot was heated at 1150° C. for 1 hour, and then hot rolled to obtain a hot-rolled steel sheet of 3.5 mm in sheet thickness. The hot-rolled steel sheet was subjected to hot-rolled sheet annealing of holding at 800° C. for 10 hours to obtain a hot-rolled and annealed steel sheet. The front and back sides of the hot-rolled and annealed steel sheet were then ground to remove scale. After this, the hot-rolled and annealed steel sheet was cold rolled using a cluster mill to prepare a blank steel sheet (cold-rolled steel sheet) of 1.0 mm in sheet thickness having Ra and RSm shown in Table 5. In the final pass of cold rolling, Ra and RSm of the blank steel sheet were variously adjusted using a plurality of types of rolling rolls produced by polishing using different polishing methods. The rolling reduction ratio in the final pass of cold rolling was 15% to 17%.

The blank steel sheet was then annealed to obtain an annealed steel sheet (cold-rolled and annealed steel sheet). The annealing was performed by holding the blank steel sheet at 850° C. for 1 minute in a mixed atmosphere of hydrogen 25 vol %-nitrogen 75 vol %.

The annealed steel sheet was then subjected to pickling according to Embodiment 3 under the conditions shown in Table 5. The annealed steel sheet was then subjected to skin pass rolling under the conditions shown in Table 5 to obtain a ferritic stainless steel sheet.

The obtained ferritic stainless steel sheet was cut into 300 mm in length and 200 mm in width, and the steel microstructure was identified and various surface texture parameters (the area ratio of the plateau portions, the area ratio of the valley portions, Sdr of the plateau portions, Sdq of the valley portions, Sal, and Str) were measured in the same manner as in Example 1. The results are shown in Table 5. The chemical composition of each eventually obtained ferritic stainless steel sheet was substantially the same as the chemical composition of the corresponding steel sample ID shown in Table 4, and satisfied the range of the second chemical composition except for test No. 3-45 using steel sample ID 2T. It was also determined that its microstructure contained ferrite phase with an area ratio of more than 95%.

For each obtained ferritic stainless steel sheet, (i) whiteness, (ii) image clarity, and (iii) surface roughness resistance were evaluated in the same manner as in Example 1 based on the same criteria as in Example 1. The results are shown in Table 5.

TABLE 4

| Steel sample | Chemical composition (mass %) | | | | | | | | | |
|---|---|---|---|---|---|---|---|---|---|---|
| ID | C | Si | Mn | P | S | Ni | Cr | Al | N | Others |
| 2A | 0.037 | 0.23 | 0.56 | 0.025 | 0.003 | 0.16 | 16.3 | 0.001 | 0.048 | |
| 2B | 0.018 | 0.14 | 0.78 | 0.028 | 0.004 | 0.17 | 16.1 | 0.003 | 0.035 | |
| 2C | 0.011 | 0.29 | 0.52 | 0.023 | 0.005 | 0.21 | 16.5 | 0.004 | 0.013 | |
| 2D | 0.112 | 0.32 | 0.89 | 0.028 | 0.003 | 0.21 | 16.3 | 0.004 | 0.068 | |
| 2E | 0.061 | 0.03 | 0.22 | 0.029 | 0.001 | 0.26 | 16.1 | 0.004 | 0.026 | |
| 2F | 0.051 | 0.92 | 0.96 | 0.025 | 0.005 | 0.23 | 16.3 | 0.002 | 0.049 | |
| 2G | 0.048 | 0.47 | 0.34 | 0.029 | 0.003 | 0.20 | 11.2 | 0.002 | 0.026 | |
| 2H | 0.049 | 0.27 | 0.42 | 0.029 | 0.004 | 0.28 | 13.3 | 0.003 | 0.011 | |
| 2I | 0.041 | 0.24 | 0.84 | 0.025 | 0.005 | 0.14 | 17.8 | 0.001 | 0.049 | |
| 2J | 0.050 | 0.41 | 0.51 | 0.021 | 0.005 | 0.12 | 19.6 | 0.003 | 0.024 | |
| 2K | 0.076 | 0.66 | 0.44 | 0.024 | 0.006 | 0.02 | 16.1 | 0.001 | 0.021 | |
| 2L | 0.044 | 0.47 | 0.35 | 0.021 | 0.005 | 0.75 | 16.2 | 0.464 | 0.027 | |
| 2M | 0.043 | 0.25 | 0.72 | 0.027 | 0.005 | 0.11 | 16.3 | 0.002 | 0.040 | Mo: 0.38 |
| 2N | 0.079 | 0.43 | 0.58 | 0.025 | 0.003 | 0.15 | 16.3 | 0.003 | 0.032 | Ti: 0.02, Nb: 0.03 |
| 2O | 0.070 | 0.55 | 0.74 | 0.020 | 0.003 | 0.08 | 16.4 | 0.003 | 0.026 | Sn: 0.14 |
| 2P | 0.046 | 0.66 | 0.43 | 0.026 | 0.006 | 0.19 | 16.4 | 0.003 | 0.019 | Cu: 0.13, W: 0.15, V: 0.04 |
| 2Q | 0.054 | 0.25 | 0.85 | 0.029 | 0.003 | 0.27 | 16.0 | 0.003 | 0.018 | Co: 0.16, B: 0.0009, Mg: 0.0022, La: 0.02 |
| 2R | 0.070 | 0.47 | 0.73 | 0.023 | 0.003 | 0.29 | 16.2 | 0.003 | 0.034 | Zr: 0.03, Ca: 0.0011 |
| 2S | 0.031 | 0.64 | 0.36 | 0.029 | 0.005 | 0.06 | 16.4 | 0.003 | 0.045 | Mo: 0.14, Ti: 0.03, Y: 0.02, Sb: 0.17 |
| 2T | 0.029 | 0.46 | 0.58 | 0.023 | 0.003 | 0.23 | 21.5 | 0.003 | 0.027 | |

TABLE 5

| | | Preparation | | Pickling | | | | Skin pass rolling | | Surface texture | | | | | | Evaluation results | | | |
|---|---|---|---|---|---|---|---|---|---|---|---|---|---|---|---|---|---|---|---|
| | | | | Treatment solution | | | | | | | | | | | | | | | |
| | Steel | Blank steel sheet | | Hydrofluoric acid | Nitric acid | Treatment | Treatment | Skin pass roll | Elongation | Plateau portions Area | | Valley portions Area | | | | (i) | (ii) | (iii) | |
| Test No. | sample ID | Ra (μm) | RSm (μm) | concentration (mass%) | concentration (mass %) | temperature (° C.) | time (s) | Ra (μm) | ratio (%) | ratio (%) | Sdr | ratio (%) | Sdq | Sal (μm) | Str | Whiteness | Image clarity | Surface roughness resistance | Remarks |
| 3-1 | 2A | 0.09 | 12.2 | 3.2 | 5.9 | 55 | 51 | 0.02 | 0.38 | 56 | 0.045 | 44 | 0.57 | 12.4 | 0.60 | ◎ | ◎ | ◎ | Example |
| 3-2 | 2B | 0.13 | 16.7 | 3.3 | 4.4 | 50 | 59 | 0.04 | 0.51 | 45 | 0.044 | 55 | 0.45 | 12.7 | 0.65 | ◎ | ◎ | ◎ | Example |
| 3-3 | 2C | 0.11 | 17.5 | 3.8 | 5.4 | 55 | 47 | 0.04 | 0.69 | 59 | 0.029 | 41 | 0.52 | 9.6 | 0.61 | ◎ | ◎ | ◎ | Example |
| 3-4 | 2D | 0.11 | 10.8 | 3.3 | 5.8 | 55 | 57 | 0.03 | 0.50 | 45 | 0.038 | 55 | 0.56 | 10.4 | 0.50 | ◎ | ◎ | ◎ | Example |
| 3-5 | 2E | 0.12 | 19.7 | 3.7 | 7.0 | 53 | 45 | 0.03 | 0.33 | 58 | 0.050 | 42 | 0.51 | 8.5 | 0.55 | ◎ | ◎ | ◎ | Example |
| 3-6 | 2F | 0.13 | 11.2 | 3.2 | 4.4 | 51 | 59 | 0.05 | 0.56 | 58 | 0.031 | 42 | 0.49 | 9.1 | 0.56 | ◎ | ◎ | ◎ | Example |
| 3-7 | 2G | 0.08 | 11.4 | 3.9 | 4.4 | 50 | 46 | 0.04 | 0.31 | 56 | 0.022 | 44 | 0.49 | 11.9 | 0.65 | ◎ | ◎ | ◎ | Example |
| 3-8 | 2H | 0.12 | 10.8 | 3.7 | 6.2 | 56 | 55 | 0.04 | 0.60 | 44 | 0.030 | 56 | 0.62 | 7.7 | 0.55 | ◎ | ◎ | ◎ | Example |
| 3-9 | 2I | 0.12 | 15.1 | 3.3 | 4.6 | 47 | 77 | 0.04 | 0.44 | 54 | 0.043 | 46 | 0.58 | 6.9 | 0.56 | ◎ | ◎ | ◎ | Example |
| 3-10 | 2J | 0.12 | 15.3 | 3.5 | 5.0 | 58 | 95 | 0.04 | 0.54 | 42 | 0.038 | 58 | 0.62 | 13.9 | 0.60 | ◎ | ◎ | ◎ | Example |
| 3-11 | 2K | 0.09 | 15.1 | 3.2 | 4.4 | 51 | 46 | 0.04 | 0.54 | 57 | 0.040 | 43 | 0.59 | 12.7 | 0.59 | ◎ | ◎ | ◎ | Example |
| 3-12 | 2L | 0.11 | 12.8 | 3.3 | 4.7 | 48 | 48 | 0.03 | 0.37 | 48 | 0.045 | 52 | 0.53 | 8.5 | 0.62 | ◎ | ◎ | ◎ | Example |
| 3-13 | 2M | 0.11 | 19.9 | 3.4 | 5.4 | 54 | 57 | 0.04 | 0.54 | 52 | 0.029 | 48 | 0.62 | 9.9 | 0.61 | ◎ | ◎ | ◎ | Example |
| 3-14 | 2N | 0.13 | 19.0 | 3.4 | 6.8 | 53 | 46 | 0.05 | 0.67 | 50 | 0.045 | 50 | 0.50 | 12.4 | 0.60 | ◎ | ◎ | ◎ | Example |
| 3-15 | 2O | 0.12 | 11.3 | 3.8 | 4.8 | 55 | 48 | 0.05 | 0.38 | 51 | 0.025 | 49 | 0.46 | 9.9 | 0.64 | ◎ | ◎ | ◎ | Example |
| 3-16 | 2P | 0.10 | 11.9 | 3.0 | 4.5 | 57 | 49 | 0.03 | 0.39 | 56 | 0.042 | 44 | 0.51 | 12.2 | 0.49 | ◎ | ◎ | ◎ | Example |
| 3-17 | 2Q | 0.12 | 19.8 | 3.1 | 5.0 | 56 | 48 | 0.05 | 0.45 | 58 | 0.043 | 42 | 0.54 | 8.0 | 0.62 | ◎ | ◎ | ◎ | Example |
| 3-18 | 2R | 0.10 | 13.4 | 3.2 | 4.2 | 51 | 51 | 0.02 | 0.33 | 55 | 0.026 | 45 | 0.47 | 8.5 | 0.52 | ◎ | ◎ | ◎ | Example |
| 3-19 | 2S | 0.09 | 12.9 | 3.3 | 5.0 | 57 | 49 | 0.05 | 0.46 | 48 | 0.025 | 52 | 0.62 | 6.9 | 0.53 | ◎ | ◎ | ◎ | Example |
| 3-20 | 2A | 0.17 | 18.2 | 3.1 | 6.8 | 54 | 48 | 0.04 | 0.28 | 51 | 0.021 | 49 | 0.55 | 5.8 | 0.42 | ◎ | ◎ | ○ | Example |
| 3-21 | 2A | 0.11 | 45.0 | 3.8 | 6.5 | 50 | 50 | 0.03 | 0.74 | 53 | 0.034 | 47 | 0.52 | 23.3 | 0.49 | ◎ | ◎ | ○ | Example |
| 3-22 | 2A | 0.12 | 17.8 | 3.7 | 6.5 | 31 | 54 | 0.05 | 0.53 | 50 | 0.029 | 50 | 0.33 | 10.6 | 0.61 | ○ | ◎ | ◎ | Example |
| 3-23 | 2A | 0.08 | 19.8 | 3.1 | 5.6 | 62 | 59 | 0.04 | 0.54 | 50 | 0.074 | 50 | 0.55 | 5.1 | 0.46 | ◎ | ○ | ◎ | Example |
| 3-24 | 2A | 0.09 | 11.4 | 1.1 | 5.2 | 48 | 52 | 0.04 | 0.73 | 44 | 0.041 | 56 | 0.34 | 6.1 | 0.59 | ○ | ◎ | ◎ | Example |
| 3-25 | 2A | 0.13 | 17.6 | 7.8 | 5.9 | 57 | 48 | 0.03 | 0.39 | 57 | 0.066 | 43 | 0.51 | 9.0 | 0.55 | ◎ | ○ | ◎ | Example |
| 3-26 | 2A | 0.10 | 13.0 | 3.6 | 2.2 | 56 | 52 | 0.03 | 0.42 | 51 | 0.040 | 49 | 0.35 | 13.8 | 0.64 | ○ | ◎ | ◎ | Example |
| 3-27 | 2A | 0.12 | 13.5 | 3.7 | 11.5 | 56 | 50 | 0.03 | 0.72 | 56 | 0.035 | 44 | 0.36 | 11.7 | 0.49 | ○ | ◎ | ◎ | Example |
| 3-28 | 2A | 0.12 | 13.5 | 3.3 | 6.2 | 57 | 27 | 0.03 | 0.40 | 50 | 0.027 | 50 | 0.31 | 6.8 | 0.65 | ○ | ◎ | ◎ | Example |
| 3-29 | 2A | 0.11 | 12.7 | 4.0 | 6.4 | 51 | 587 | 0.03 | 0.35 | 55 | 0.071 | 45 | 0.61 | 9.6 | 0.57 | ◎ | ○ | ◎ | Example |
| 3-30 | 2A | 0.08 | 19.0 | 3.4 | 4.9 | 49 | 45 | 0.08 | 0.60 | 42 | 0.074 | 58 | 0.49 | 12.5 | 0.52 | ◎ | ○ | ◎ | Example |
| 3-31 | 2A | 0.08 | 16.3 | 3.4 | 4.4 | 53 | 57 | 0.04 | 0.12 | 33 | 0.044 | 67 | 0.47 | 9.5 | 0.46 | ◎ | ○ | ◎ | Example |
| 3-32 | 2A | 0.10 | 12.1 | 3.1 | 5.1 | 49 | 47 | 0.04 | 1.34 | 66 | 0.028 | 34 | 0.51 | 8.1 | 0.62 | ○ | ◎ | ◎ | Example |
| 3-33 | 2A | 0.27 | 15.2 | 3.9 | 5.9 | 49 | 57 | 0.03 | 0.44 | 42 | 0.021 | 58 | 0.59 | 6.3 | 0.23 | ◎ | ◎ | X | Comparative Example |
| 3-34 | 2A | 0.08 | 84.1 | 3.2 | 4.8 | 51 | 46 | 0.04 | 0.49 | 44 | 0.050 | 56 | 0.47 | 59.2 | 0.51 | ◎ | ◎ | X | Comparative Example |
| 3-35 | 2A | 0.10 | 17.5 | 3.7 | 5.1 | 25 | 60 | 0.03 | 0.57 | 69 | 0.043 | 31 | 0.16 | 7.4 | 0.48 | X | ○ | ◎ | Comparative Example |
| 3-36 | 2A | 0.10 | 18.2 | 0.5 | 4.8 | 55 | 54 | 0.02 | 0.70 | 55 | 0.026 | 45 | 0.13 | 8.8 | 0.52 | X | ◎ | ◎ | Comparative Example |
| 3-37 | 2A | 0.11 | 13.9 | 8.7 | 6.2 | 56 | 55 | 0.03 | 0.45 | 58 | 0.134 | 42 | 0.60 | 14.6 | 0.61 | ◎ | X | ◎ | Comparative Example |
| 3-38 | 2A | 0.09 | 19.1 | 3.6 | 1.1 | 52 | 53 | 0.04 | 0.49 | 51 | 0.041 | 49 | 0.07 | 13.9 | 0.56 | X | ◎ | ◎ | Comparative Example |
| 3-39 | 2A | 0.08 | 12.4 | 3.7 | 13.2 | 57 | 46 | 0.05 | 0.30 | 45 | 0.048 | 55 | 0.11 | 5.8 | 0.49 | X | ◎ | ◎ | Comparative Example |
| 3-40 | 2A | 0.12 | 18.5 | 3.6 | 4.4 | 57 | 18 | 0.04 | 0.28 | 50 | 0.043 | 50 | 0.12 | 10.7 | 0.49 | X | ◎ | ◎ | Comparative Example |

TABLE 5-continued

| | | Preparation | | Pickling | | | | Skin pass rolling | | Surface texture | | | | | | Evaluation results | | | |
|---|---|---|---|---|---|---|---|---|---|---|---|---|---|---|---|---|---|---|---|
| | | | | Treatment solution | | | | | | | | | | | | | | | |
| | Steel | Blank steel sheet | | Hydrofluoric acid | Nitric acid | Treatment | Treatment | Skin pass roll | Elongation | Plateau portions Area | | Valley portions Area | | | | (i) | (ii) | (iii) Surface | |
| Test No. | sample ID | Ra (μm) | RSm (μm) | concentration (mass%) | concentration (mass %) | temperature (° C.) | time (s) | Ra (μm) | ratio (%) | ratio (%) | Sdr | ratio (%) | Sdq | Sal (μm) | Str | Whiteness | Image clarity | roughness resistance | Remarks |
| 3-41 | 2A | 0.08 | 19.3 | 3.3 | 6.2 | 52 | 669 | 0.03 | 0.40 | 58 | 0.142 | 42 | 0.46 | 13.6 | 0.50 | ◎ | X | ◎ | Comparative Example |
| 3-42 | 2A | 0.12 | 14.0 | 3.7 | 6.7 | 54 | 55 | 0.19 | 0.51 | 42 | 0.120 | 58 | 0.51 | 13.2 | 0.57 | ◎ | X | ◎ | Comparative Example |
| 3-43 | 2A | 0.10 | 10.5 | 3.7 | 5.8 | 56 | 59 | 0.05 | 0.05 | 23 | 0.036 | 77 | 0.57 | 14.1 | 0.54 | ◎ | X | ◎ | Comparative Example |
| 3-44 | 2A | 0.11 | 13.9 | 3.3 | 4.7 | 54 | 45 | 0.03 | 2.33 | 74 | 0.040 | 26 | 0.55 | 5.1 | 0.58 | X | ◎ | ◎ | Comparative Example |
| 3-45 | 2T | 0.09 | 15.6 | 3.7 | 6.7 | 49 | 59 | 0.03 | 0.73 | 44 | 0.027 | 56 | 0.06 | 13.8 | 0.50 | X | ◎ | ◎ | Comparative Example |

As shown in Table 5, all Examples satisfied the required characteristics of (i), (ii), and (iii) above. In all Examples in (Example 3) produced by the mixed acid pickling single method of Embodiment 3, the required characteristics were evaluated higher than or equal to those in Examples in (Example 1 and 2) produced by the dull rolling method of Embodiments 1 and 2. The required characteristics were evaluated particularly high in Examples produced under preferable production conditions (test Nos. 3-1 to 3-19).

On the other hand, all Comparative Examples failed to satisfy at least one of the required characteristics (i), (ii), and (iii).

In detail, in Comparative Example of test No. 3-33, since Ra of the blank steel sheet was above the appropriate range, Str of the steel sheet surface was high, so that the desired surface roughness resistance could not be obtained and surface roughness was noticeable.

In Comparative Example of test No. 3-34, since RSm of the blank steel sheet was above the appropriate range, Sal of the steel sheet surface was high, so that the desired surface roughness resistance could not be obtained and surface roughness was noticeable.

In Comparative Example of test No. 3-35, since the treatment temperature was below the appropriate range, Sdq of the valley portions was low and the desired whiteness could not be obtained.

In Comparative Example of test No. 3-36, since the hydrofluoric acid concentration of the treatment solution was below the appropriate range, Sdq of the valley portions was low and the desired whiteness could not be obtained.

In Comparative Example of test No. 3-37, since the hydrofluoric acid concentration of the treatment solution was above the appropriate range, Sdr of the plateau portions was high and the desired image clarity could not be obtained.

In Comparative Example of test No. 3-38, since the nitric acid concentration of the treatment solution was below the appropriate range, Sdq of the valley portions was low and the desired whiteness could not be obtained.

In Comparative Example of test No. 3-39, since the nitric acid concentration of the treatment solution was above the appropriate range, Sdq of the valley portions was low and the desired whiteness could not be obtained.

In Comparative Example of test No. 3-40, since the treatment time was below the appropriate range, Sdq of the valley portions was low and the desired whiteness could not be obtained.

In Comparative Example of test No. 3-41, since the treatment time was above the appropriate range, Sdr of the plateau portions was high and the desired image clarity could not be obtained.

In Comparative Example of test No. 3-42, since Ra of the skin pass roll was above the appropriate range, Sdr of the plateau portions was high and the desired image clarity could not be obtained.

In Comparative Example of test No. 3-43, since the elongation ratio of skin pass rolling was below the appropriate range, the area ratio of the plateau portions was low and the desired image clarity could not be obtained.

In Comparative Example of test No. 3-44, since the elongation ratio of skin pass rolling was above the appropriate range, the area ratio of the valley portions was low and the desired whiteness could not be obtained.

In Comparative Example of test No. 3-45, Sdq of the valley portions was low and the desired whiteness could not be obtained.

INDUSTRIAL APPLICABILITY

A ferritic stainless steel sheet according to the present disclosure is particularly suitable for use in corrosion-resistant parts required to have calm color tones, such as commercial refrigerator panels, elevator inner panels, sink top panels, home appliance parts, and interior materials.

The invention claimed is:

1. A ferritic stainless steel sheet, wherein a surface of the ferritic stainless steel sheet is made up of plateau portions and valley portions, an area ratio of the plateau portions is 30% to 70%, Sdr of the plateau portions is 0.100 or less, and Sdq of the valley portions is 0.20 or more, and Sal is 50 μm or less, and Str is 0.30 or more, where Sdr, Sdq, Sal, and Str are a developed interfacial area ratio of scale-limited surface, a root mean square gradient of scale-limited surface, an autocorrelation length, and a texture aspect ratio defined in JIS B 0681-2: 2018, respectively.

2. The ferritic stainless steel sheet according to claim 1, wherein L* is 50 or more, and C (2.0) is 10% or more, and a maximum autocorrelation length is 50 μm or less, where L* is a lightness index defined in JIS Z 8781-4: 2013, C(2.0) is an image clarity defined in JIS K 7374: 2007, and the maximum autocorrelation length is a value that, in an autocorrelation image obtained by performing image processing on a microscopic image of a surface of the stainless steel sheet by a coaxial epi-illumination method, is obtained by dividing, by 2, an absolute maximum length of a region that includes a center of the image and whose pixels have luminance values greater than or equal to a reference value.

3. The ferritic stainless steel sheet according to claim 1, wherein Sal is 20 μm or less, and Str is 0.45 or more.

4. The ferritic stainless steel sheet according to claim 3, wherein a maximum autocorrelation length is 35 μm or less, and the maximum autocorrelation length is a value that, in an autocorrelation image obtained by performing image processing on a microscopic image of a surface of the stainless steel sheet by a coaxial epi-illumination method, is obtained by dividing, by 2, an absolute maximum length of a region that includes a center of the image and whose pixels have luminance values greater than or equal to a reference value.

5. The ferritic stainless steel sheet according to claim 2, wherein Sal is 20 μm or less, and Str is 0.45 or more.

6. The ferritic stainless steel sheet according to claim 5, wherein the maximum autocorrelation length is 35 μm or less.

7. A production method for the ferritic stainless steel sheet according to claim 1, the production method comprising:

preparing a material for cold rolling;

thereafter cold rolling the material for cold rolling to obtain a cold-rolled steel sheet;

thereafter annealing the cold-rolled steel sheet to obtain a cold-rolled and annealed steel sheet;

thereafter pickling the cold-rolled and annealed steel sheet; and thereafter skin pass rolling the cold-rolled and annealed steel sheet, wherein in the cold rolling, a dull roll having Ra of 1.00 μm or more, Sal of 50.0 μm or less, and Str of 0.30 or more is used in a final pass, and a rolling reduction ratio in the final pass is 0.80% or more, in the pickling, positive electrolytic treatment is performed under treatment conditions that a treatment solution is a nitrohydrochloric acid aqueous solution having a hydrochloric acid concentration of 0.10 mass % to 5.00 mass % and a nitric acid concentration of 10.0 mass % to 20.0 mass %, a treatment temperature is 30° C. to 65° C., a treatment time is 1.0 second to 60.0 seconds, and a current density is 5.0 A/dm$^2$ to 20.0 A/dm$^2$, and in the skin pass rolling, a dull roll having Ra of 0.30 μm or less is used, and an elongation ratio is 0.10% to 3.00%, where Sal and Str are an autocorrelation length and a texture aspect ratio defined in JIS B 0681-2: 2018, respectively, and Ra is an arithmetic mean roughness defined in JIS B 0601: 2013.

8. A production method for the ferritic stainless steel sheet according to claim 1, the production method comprising:

preparing a material for cold rolling;

thereafter cold rolling the material for cold rolling to obtain a cold-rolled steel sheet;

thereafter annealing the cold-rolled steel sheet to obtain a cold-rolled and annealed steel sheet;

thereafter pickling the cold-rolled and annealed steel sheet; and thereafter skin pass rolling the cold-rolled and annealed steel sheet, wherein in the cold rolling, a dull roll having Ra of 1.00 μm or more, Sal of 50.0 μm or less, and Str of 0.30 or more is used in a final pass, and a rolling reduction ratio in the final pass is 0.80% or more, in the pickling, immersion treatment is performed under treatment conditions that a treatment solution is a mixed acid aqueous solution having a hydrofluoric acid concentration of 1.0 mass % to 8.0 mass % and a nitric acid concentration of 2.0 mass % to 12.0 mass %, a treatment temperature is 30° C. to 65° C., and a treatment time is 25 seconds to 600 seconds, and in the skin pass rolling, a dull roll having Ra of 0.30 μm or less is used, and an elongation ratio is 0.10% to 3.00%, where Sal and Str are an autocorrelation length and a texture aspect ratio defined in JIS B 0681-2: 2018, respectively, and Ra is an arithmetic mean roughness defined in JIS B 0601: 2013.

9. A production method for the ferritic stainless steel sheet according to claim 1, the production method comprising:

preparing a blank steel sheet;

thereafter annealing the blank steel sheet to obtain an annealed steel sheet;

thereafter pickling the annealed steel sheet; and thereafter skin pass rolling the annealed steel sheet, wherein the blank steel sheet has Ra of 0.20 μm or less and RSm of 50.0 μm or less, in the pickling, immersion treatment is performed under treatment conditions that a treatment solution is a mixed acid aqueous solution having a hydrofluoric acid concentration of 1.0 mass % to 8.0 mass % and a nitric acid concentration of 2.0 mass % to 12.0 mass %, a treatment temperature is 30° C. to 65° C., and a treatment time is 25 seconds to 600 seconds, and in the skin pass rolling, a dull roll having Ra of 0.09 μm or less is used, and an elongation ratio is 0.10% to 1.50%, where Ra and RSm are an arithmetic mean roughness and a mean width of roughness profile elements defined in JIS B 0601: 2013, respectively.

10. A production method for the ferritic stainless steel sheet according to claim 2, the production method comprising:

preparing a material for cold rolling;

thereafter cold rolling the material for cold rolling to obtain a cold-rolled steel sheet;

thereafter annealing the cold-rolled steel sheet to obtain a cold-rolled and annealed steel sheet;

thereafter pickling the cold-rolled and annealed steel sheet; and thereafter skin pass rolling the cold-rolled and annealed steel sheet, wherein in the cold rolling, a dull roll having Ra of 1.00 μm or more, Sal of 50.0 μm or less, and Str of 0.30 or more is used in a final pass, and a rolling reduction ratio in the final pass is 0.80% or more, in the pickling, positive electrolytic treatment is performed under treatment conditions that a treatment solution is a nitrohydrochloric acid aqueous solution having a hydrochloric acid concentration of 0.10 mass % to 5.00 mass % and a nitric acid concentration of 10.0 mass % to 20.0 mass %, a treatment temperature is 30° C. to 65° C., a treatment time is 1.0 second to 60.0 seconds, and a current density is 5.0 A/dm$^2$ to 20.0 A/dm$^2$, and in the skin pass rolling, a dull roll having Ra of 0.30 μm or less is used, and an elongation ratio is 0.10% to 3.00%, where Sal and Str are an autocorrelation length and a texture aspect ratio defined in JIS B 0681-2: 2018, respectively, and Ra is an arithmetic mean roughness defined in JIS B 0601: 2013.

11. A production method for the ferritic stainless steel sheet according to claim 2, the production method comprising:

preparing a material for cold rolling;

thereafter cold rolling the material for cold rolling to obtain a cold-rolled steel sheet;

thereafter annealing the cold-rolled steel sheet to obtain a cold-rolled and annealed steel sheet;

thereafter pickling the cold-rolled and annealed steel sheet; and thereafter skin pass rolling the cold-rolled and annealed steel sheet, wherein in the cold rolling, a dull roll having Ra of 1.00 μm or more, Sal of 50.0 μm or less, and Str of 0.30 or more is used in a final pass, and a rolling reduction ratio in the final pass is 0.80% or more, in the pickling, immersion treatment is performed under treatment conditions that a treatment solution is a mixed acid aqueous solution having a hydrofluoric acid concentration of 1.0 mass % to 8.0 mass % and a nitric acid concentration of 2.0 mass % to 12.0 mass %, a treatment temperature is 30° C. to 65° C., and a treatment time is 25 seconds to 600 seconds, and in the skin pass rolling, a dull roll having Ra of 0.30 μm or less is used, and an elongation ratio is 0.10% to 3.00%, where Sal and Str are an autocorrelation length and a texture aspect ratio defined in JIS B 0681-2: 2018, respectively, and Ra is an arithmetic mean roughness defined in JIS B 0601: 2013.

12. A production method for the ferritic stainless steel sheet according to claim 2, the production method comprising:

preparing a blank steel sheet;

thereafter annealing the blank steel sheet to obtain an annealed steel sheet;

thereafter pickling the annealed steel sheet; and thereafter skin pass rolling the annealed steel sheet, wherein the blank steel sheet has Ra of 0.20 μm or less and RSm of 50.0 μm or less, in the pickling, immersion treatment is performed under treatment conditions that a treatment solution is a mixed acid aqueous solution having a hydrofluoric acid concentration of 1.0 mass % to 8.0 mass % and a nitric acid concentration of 2.0 mass % to 12.0 mass %, a treatment temperature is 30° C. to 65° C., and a treatment time is 25 seconds to 600 seconds, and in the skin pass rolling, a dull roll having Ra of 0.09 μm or less is used, and an elongation ratio is 0.10% to 1.50%, where Ra and RSm are an arithmetic mean roughness and a mean width of roughness profile elements defined in JIS B 0601: 2013, respectively.

13. A production method for the ferritic stainless steel sheet according to claim 3, the production method comprising:

preparing a blank steel sheet;

thereafter annealing the blank steel sheet to obtain an annealed steel sheet;

thereafter pickling the annealed steel sheet; and thereafter skin pass rolling the annealed steel sheet, wherein the blank steel sheet has Ra of 0.20 μm or less and RSm of 50.0 μm or less, in the pickling, immersion treatment is performed under treatment conditions that a treatment solution is a mixed acid aqueous solution having a hydrofluoric acid concentration of 1.0 mass % to 8.0 mass % and a nitric acid concentration of 2.0 mass % to 12.0 mass %, a treatment temperature is 30° C. to 65° C., and a treatment time is 25 seconds to 600 seconds, and in the skin pass rolling, a dull roll having Ra of 0.09 μm or less is used, and an elongation ratio is 0.10% to 1.50%, where Ra and RSm are an arithmetic mean roughness and a mean width of roughness profile elements defined in JIS B 0601: 2013, respectively.

14. A production method for the ferritic stainless steel sheet according to claim 4, the production method comprising:

preparing a blank steel sheet;

thereafter annealing the blank steel sheet to obtain an annealed steel sheet;

thereafter pickling the annealed steel sheet; and thereafter skin pass rolling the annealed steel sheet, wherein the blank steel sheet has Ra of 0.20 μm or less and RSm of 50.0 μm or less, in the pickling, immersion treatment is performed under treatment conditions that a treatment solution is a mixed acid aqueous solution having a hydrofluoric acid concentration of 1.0 mass % to 8.0 mass % and a nitric acid concentration of 2.0 mass % to 12.0 mass %, a treatment temperature is 30° C. to 65° C., and a treatment time is 25 seconds to 600 seconds, and in the skin pass rolling, a dull roll having Ra of 0.09 μm or less is used, and an elongation ratio is 0.10% to 1.50%, where Ra and RSm are an arithmetic mean roughness and a mean width of roughness profile elements defined in JIS B 0601: 2013, respectively.

15. A production method for the ferritic stainless steel sheet according to claim 5, the production method comprising:

preparing a blank steel sheet;

thereafter annealing the blank steel sheet to obtain an annealed steel sheet;

thereafter pickling the annealed steel sheet; and thereafter skin pass rolling the annealed steel sheet, wherein the blank steel sheet has Ra of 0.20 μm or less and RSm of 50.0 μm or less, in the pickling, immersion treatment is performed under treatment conditions that a treatment solution is a mixed acid aqueous solution having a hydrofluoric acid concentration of 1.0 mass % to 8.0 mass % and a nitric acid concentration of 2.0 mass % to 12.0 mass %, a treatment temperature is 30° C. to 65° C., and a treatment time is 25 seconds to 600 seconds, and in the skin pass rolling, a dull roll having Ra of 0.09 μm or less is used, and an elongation ratio is 0.10% to 1.50%, where Ra and RSm are an arithmetic mean roughness and a mean width of roughness profile elements defined in JIS B 0601: 2013, respectively.

16. A production method for the ferritic stainless steel sheet according to claim 6, the production method comprising:

preparing a blank steel sheet;

thereafter annealing the blank steel sheet to obtain an annealed steel sheet;

thereafter pickling the annealed steel sheet; and thereafter skin pass rolling the annealed steel sheet, wherein the blank steel sheet has Ra of 0.20 μm or less and RSm of 50.0 μm or less, in the pickling, immersion treatment is performed under treatment conditions that a treatment solution is a mixed acid aqueous solution having a hydrofluoric acid concentration of 1.0 mass % to 8.0 mass % and a nitric acid concentration of 2.0 mass % to 12.0 mass %, a treatment temperature is 30° C. to 65° C., and a treatment time is 25 seconds to 600 seconds, and in the skin pass rolling, a dull roll having Ra of 0.09 μm or less is used, and an elongation ratio is 0.10% to 1.50%, where Ra and RSm are an arithmetic mean roughness and a mean width of roughness profile elements defined in JIS B 0601: 2013, respectively.

* * * * *